US010225644B2

(12) United States Patent
Goto et al.

(10) Patent No.: US 10,225,644 B2
(45) Date of Patent: Mar. 5, 2019

(54) SPEAKER SYSTEM

(71) Applicant: Kabushiki Kaisha Toshiba, Minato-ku (JP)

(72) Inventors: Tatsuhiko Goto, Kawasaki (JP); Akihiko Enamito, Kawasaki (JP); Osamu Nishimura, Kawasaki (JP)

(73) Assignee: Kabushiki Kaisha Toshiba, Minato-ku (JP)

( * ) Notice: Subject to any disclaimer, the term of this patent is extended or adjusted under 35 U.S.C. 154(b) by 0 days.

(21) Appl. No.: 15/443,033

(22) Filed: Feb. 27, 2017

(65) Prior Publication Data

US 2017/0332165 A1 Nov. 16, 2017

(30) Foreign Application Priority Data

May 13, 2016 (JP) ..... 2016-096975

(51) Int. Cl.
*H04R 1/02* (2006.01)
*H04R 1/10* (2006.01)
(Continued)

(52) U.S. Cl.
CPC ..... *H04R 1/24* (2013.01); *H04R 1/025* (2013.01); *H04R 3/04* (2013.01); *H04R 3/14* (2013.01);
(Continued)

(58) Field of Classification Search
None
See application file for complete search history.

(56) References Cited

U.S. PATENT DOCUMENTS 4,150,262 A * 4/1979 Ono ..... H04M 1/62 381/190
5,185,801 A * 2/1993 Meyer ..... H04R 3/04 381/59
(Continued)

FOREIGN PATENT DOCUMENTS

JP 2004-328408 11/2004
JP 3946127 7/2007
(Continued)

OTHER PUBLICATIONS

Masato Miyoshi et al "Inverse Filtering of Room Acoustics", IEEE Transactions on Acoustics, Speech, and Signal Processing, vol. 36, No. 2, 1988, 8 pages.
(Continued)

*Primary Examiner* — Thomas H Maung
*Assistant Examiner* — Kenny H Truong
(74) *Attorney, Agent, or Firm* — Oblon, McClelland, Maier & Neustadt, L.L.P.

(57) ABSTRACT

According to one embodiment, a speaker system includes a plurality of filters and a plurality of speakers. The filters filter a first signal to generate a plurality of second signals. The speakers convert the second signals into respective sound waves. Each speaker has a diaphragm and a vibration source installed in the diaphragm. Diaphragms of the speakers have at least two different shapes. Respective transfer characteristics of the diaphragms are different from each other. Each filter corresponding to the respective transfer characteristics is set such that a transfer characteristic of a synthetic sound wave of the respective sound waves approaches a target transfer characteristic.

24 Claims, 18 Drawing Sheets

(51) Int. Cl.

| | |
|---|---|
| ***H04R 1/24*** | (2006.01) |
| ***H04R 3/04*** | (2006.01) |
| ***H04R 3/14*** | (2006.01) |
| ***H04R 17/00*** | (2006.01) |

(52) U.S. Cl.
CPC ..... *H04R 17/00* (2013.01); *H04R 1/1008* (2013.01); *H04R 1/1016* (2013.01); *H04R 1/1083* (2013.01); *H04R 2460/01* (2013.01)

(56) References Cited

U.S. PATENT DOCUMENTS

| | | | | |
|---|---|---|---|---|
| 5,277,184 | A * | 1/1994 | Messana | A61B 5/055 324/318 |
| 8,014,547 | B2 | 9/2011 | Ogura et al. | |
| 8,891,333 | B2 | 11/2014 | Onishi et al. | |
| 2009/0214049 | A1* | 8/2009 | Lee | H04R 1/40 381/71.1 |
| 2012/0321107 | A1* | 12/2012 | Chen | H04R 1/2826 381/150 |
| 2015/0271603 | A1 | 9/2015 | Goto et al. | |

FOREIGN PATENT DOCUMENTS

| | | |
|---|---|---|
| JP | 4548783 | 9/2010 |
| JP | 2010-227500 | 10/2010 |
| JP | 4846710 | 12/2011 |
| JP | 4963979 | 6/2012 |
| JP | 5761192 | 8/2015 |
| JP | 2015-179118 | 10/2015 |

OTHER PUBLICATIONS

Tomoyuki Hori et al. "Improvement of Frequency Response for Piezo-Electric Type Loudspeaker", Technical Report of IEICE, 1995, 13 pages ( with English Translation).

* cited by examiner

SPEAKER SYSTEM

CROSS-REFERENCE TO RELATED APPLICATION

This application is based upon and claims the benefit of priority from Japanese Patent Application No. 2016-096975, filed on May 13, 2016; the entire contents of which are incorporated herein by reference.

FIELD

Embodiments described herein relate generally to a speaker system.

BACKGROUND

A piezoelectric speaker generates a sound by a piezoelectric element (transformed by a voltage) and a diaphragm (it is called "shim material") for piezoelectric element attached thereto. For example, it is used for a beeping sound of a personal alarm, an electric device, and so on. The piezoelectric element is non-magnetic material as itself. Accordingly, it is expected to be used under a strong magnetic field environment in which a general dynamic type-speaker cannot be used, for example, inside MRI (magnetic resonance imaging) device.

However, as to an earphone and a headphone including the piezoelectric speaker, the sound quality is poor.

DETAILED DESCRIPTION

According to one embodiment, a speaker system includes a plurality of filters and a plurality of speakers. The filters filter a first signal to generate a plurality of second signals. The speakers convert the second signals into respective sound waves. Each speaker has a diaphragm and a vibration source installed in the diaphragm. Diaphragms of the speakers have at least two different shapes. Respective transfer characteristics of the diaphragms are different from each other. Each filter corresponding to the respective transfer characteristics is set such that a transfer characteristic of a synthetic sound wave of the respective sound waves approaches a target transfer characteristic.

Various embodiments will be described hereinafter with reference to the accompanying drawings.

Figure 1A:
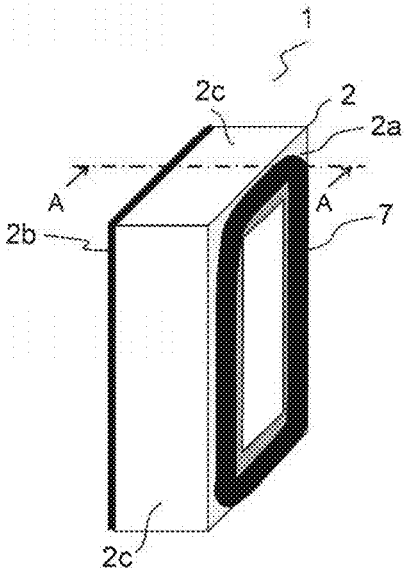
FIGS. 1A and 1B are a perspective diagram and a sectional diagram of a speaker system according to the first embodiment.
Figure 1B:
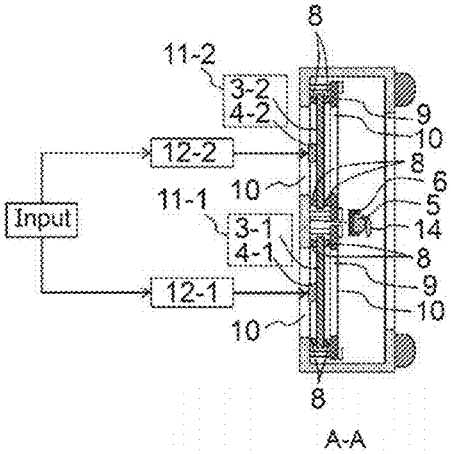

FIGS. 1A and 1B are a perspective diagram and a sectional diagram of a speaker system according to the first embodiment. The speaker system 1 of the first embodiment includes filters 12-1 and 12-2 to filter an input signal (input), and a pair of speakers 11-1 and 11-2 to generate a sound based on the filtered signal. The speaker 11-1 includes a vibration source 4-1 and a diaphragm 3-1. The speaker 11-2 includes a vibration source 4-2 and a diaphragm 3-2. The filters 12-1 and 12-2 filter the input signal and supply the filtered signal to the vibration sources 4-1 and 4-2, respectively. The filtering characteristic is preferably variable. However, as explained afterward, if a suitable filtering characteristic is set, the filtering characteristic may be fixed at this status. In order for respective transfer characteristics of the speakers 11-1 and 11-2 to be different mutually, respective shapes of the diaphragms 3-1 and 3-2 are preferably different. The speakers 11-1 and 11-2 are installed inside a package 2.

The package 2 to accommodate an ear further includes a sound collector 5 to synthesize two sound waves (generated from diaphragms 3-1 and 3-2), a holder 6 (to install the sound collector 5) and a cushion (ear pad) 7.

The package 2 includes a front face 2*a*, a back face 2*b* opposing thereto, and a side face 2*c* supposing the front face 2*a* and the back face 2*b*. For example, the back face 2*b* has a box type-component, and the inside is basically in the air. The package is basically sealed under a condition of the ear being inserted. Accordingly, the outside noise is insulated, and audibility is good.

A plurality of diaphragms is installed along the back face 2*b*. Here, in order to simplify, the case that two diaphragms 3-1 and 3-2 are aligned along top and bottom direction.

The two diaphragms 3-1 and 3-2 are supported so as to be clamped by the back face 2*b* and a presser 9 (specially installed). The back face 2*b* and the presser 9 include a plurality of clamping members 8 to clamp circumferences of the diaphragms 3-1 and 3-2. The clamping member 8 may be an elastic material such as a rubber or a packing.

On the back face 2*b* and the presser 9, a little smaller hole than each area of the diaphragms 3-1 and 3-2 is formed. The number of the holes is equal to the number of diaphragms 3 supported on the back face 2*b*. As a result, under a condition that the diaphragms 3-1 and 3-2 are supported by the back face 2*b* and the presser 9, a user can view the diaphragms 3-1 and 3-2 from the front face and the back face. The diaphragms are located between the front face 2*a* and the back face 2*b*.

Vibration sources 4-1 and 4-2 apply a vibration to the diaphragms 3-1 and 3-2, and preferably installed around a center of respective back faces of the diaphragms 3-1 and 3-2. Except for the center, for example, the vibration sources may be installed at a location corresponding to a multiple of ⅓ of a long side and a short side where all modes of the diaphragm are excited, i.e., (⅓, ⅓), (⅔, ⅓), (⅓, ⅔), (⅔, ⅔). As the vibration sources, for example, a piezo speaker, a piezo actuator, or a vibro actuator, are preferably used. By using the piezo actuator, they can be used in a strong magnetic field environment. A method for fixing the vibration source to the diaphragm is explained afterward.

The holder 6 is installed around a center between the face side 2*a* and the diaphragm 3. The sound collector 5 is fixed at the holder 6. Furthermore, a distance between the holder 6 and the diaphragm 3 can be adjusted. The sound collector 5 is used as a microphone for evaluation to create the filter 12 (explained afterward). After creating the filter 12, the sound collector 5 is not always necessary component. However, if the speaker system 1 is used as an active noise control system (ANC), wave sounds collected by the sound collector 5 are used to reduce a noise in a listener's external auditory canal 14.

The cushion (ear pad) 7 is installed so as to surround an opening of the front face 2*a*. As a material of the cushion (ear pad) 7, a material (such as a sponge) used for a general head-phone may be used.

The case of two speakers 11-1 and 11-2 was explained. However, a plurality of speakers may be prepared.

Hereafter, a method for flattening a frequency characteristic of the speaker system 1 is explained.

Figure 2:
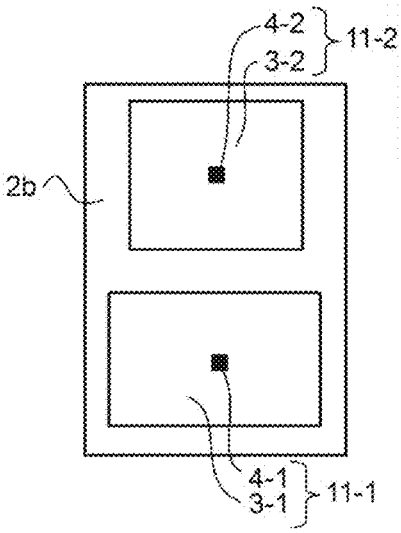
FIG. 2 is a schematic diagram of a diaphragm 3 supported on a back face 2*b*.

FIG. 2 is a schematic diagram of the diaphragm 3 supported on the back face 2*b* and the vibration source 4 stuck the diaphragm 3 (seen from the back face side), used for the speaker system 1. Here, in order to simplify, the case of two speakers 11 is explained. Components of the filter and so on are same as those of FIG. 1. Accordingly, they are omitted in FIG. 2.

In the speaker system 1 of the first embodiment, a frequency characteristic from an input signal to an output signal can be flattened. As mentioned-above, the filters 12-1 and 12-2 corresponding to the speakers 11-1 and 11-2 are included. Accordingly, a signal inputted to the speaker 11-1 is filtered by the filter 12-1. Furthermore, a signal inputted to the speaker 11-2 is filtered by the filter 12-2.

The filters 12-1 and 12-2 are designed so as to satisfy the following equation (1).

$$P_1 \cdot H_1 + P_2 \cdot H_2 = D \tag{1}$$

Here, $H_1$ and $H_2$ represent respective transfer characteristics of the filters 12-1 and 12-2. $P_1$ represents a transfer characteristic from the speaker 11-1 to the sound collector 5, and $P_2$ represents a transfer characteristic from the speaker 11-2 to the sound collector 5. A target transfer characteristic D represents a transfer characteristic from the input signal to the output signal (i.e., a sound pressure of a synthetic sound wave at the sound collector 5) as a target. The transfer characteristics $P_1$ and $P_2$ are previously measured.

In this case, the sound collector 5 functions as an evaluation microphone used for measuring transfer characteristics $P_1$ and $P_2$, and used to design the filters 12-1 and 12-2. The sound collector 5 is preferably installed at a location imaged as an entrance of the listener's external auditory canal 14. As mentioned-above, the speakers 11-1 and 11-2 are set so that transfer characteristics $P_1$ and $P_2$ are mutually different. Accordingly, respective shapes of the diaphragms 3-1 and 3-2 in FIG. 2 are different.

The input signal is filtered by the filters 12-1 and 12-2 designed so as to approach the target transfer characteristic of the equation (1), and outputted to the speakers 11-1 and 11-2 as respective output signals. The speakers 11-1 and 11-2 convert the respective output signals to a sound wave. Respective sound waves generated from the speakers 11-1 and 11-2 are outputted as a synthetic sound wave at an evaluation point (the entrance of the listener's external auditory canal) where the sound collector 5 is set. This synthetic sound wave has a flat frequency characteristic similar to the target transfer characteristic at a target band.

For example, if shapes of the diaphragms 3 have N kinds (different), transfer characteristics from respective speakers 11-1, 11-2, . . . , 11-N to the sound corrector 5 have N kinds. The sound collector 5 synthesizes respective sound waves generated from the speakers 11-1, 11-2, . . . , 11-N, and guides a synthetic sound wave to the listener's external auditory canal 14. If the target transfer characteristic is D, the filters 12-1, 12-2, . . . , 12-N are designed so as to satisfy the following equation (2).

$$\Sigma_{i=1}^{N} P_i \cdot H_i = D \tag{2}$$

Here, $H_i$ represents a transfer characteristic of the filter 12-I, $P_i$ represents a transfer characteristic from the speaker 11-I to the sound collector 5, and D represents a target transfer characteristic from the input signal to the output signal (i.e., a sound pressure of the synthetic sound wave at the sound collector 5). The transfer characteristics $P_1$, $P_2$, . . . , $P_N$ are previously measured.

The speakers 11-1, 11-2, . . . , 11-N are designed so that transfer characteristics $P_1$, $P_2$, . . . , $P_N$ are mutually different and have a complementary relationship.

In general, the target transfer characteristic is preferably flat transfer characteristic over all frequency bands. However, actually, by considering a characteristic of the speaker itself and a spatial characteristic, the target transfer characteristic is set so as to be flat at a specific frequency band. For example, in case of playing music or sound, a transfer characteristic from 100 Hz to 20 kHz needs to be flat. However, a band of the flat transfer characteristic need not be further wider. Furthermore, if the speaker system is applied to ANC, a noise sound to be reduced by ANC has a low frequency generally. Accordingly, the target transfer characteristic is preferably designed so as to be flat from 100 Hz to 2.5 kHz. In this way, the target transfer characteristic is set based on the status. In following explanation, the target band is set so as to flatten a frequency range larger than (or equal to) 100 Hz and smaller than (or equal to) 2.5 kHz.

If the shapes of the diaphragms 3 have two kinds, and if transfer characteristics $H_1$ and $H_2$ of the filters 12-1 and 12-2 satisfy the equation (1), a transfer characteristic from the input signal (input) to the output signal (output) approaches the target transfer characteristic. As a method for determining transfer characteristics $H_1$ and $H_2$ satisfying the equation (1) for example, MINT (multiple-input/output inverse-filtering theorem) is utilized. The method for designing the filters 12-1 and 12-2 is not limited to MINT, and may be arbitrary another method.

In case of using MINT, respective transfer characteristics of $P_1$ and $P_2$ are preferably not overlapped and have a complementary relationship. Accordingly, in order to acquire an ideal target transfer characteristic D, a shape of the diaphragm, a method for supporting the diaphragm, a method (or a location) for fixing the vibration source to the diaphragm, are preferably suitable.

Hereafter, the speaker system of the first embodiment is explained as practical examples.

Figure 3:
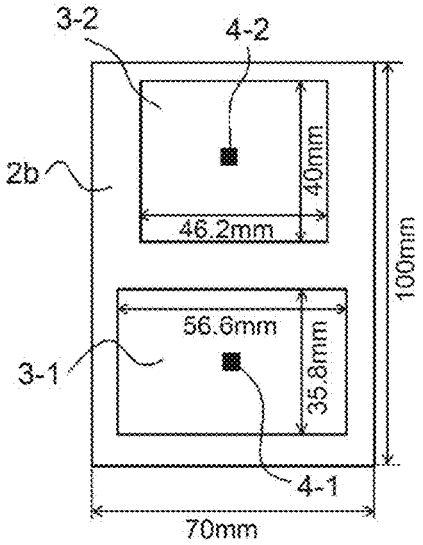
FIG. 3 is a schematic diagram showing a shape of an embodiment 1.

FIG. 3 is an embodiment 1 of the speaker system according to the first embodiment. FIG. 3 shows the speaker system drawn from the back face side. Component of filters and so on are same as those of FIG. 1. Accordingly, they are omitted in FIG. 3.

As the speakers, two diaphragms 3-1 and 3-2 are used. A size of the diaphragm 3-1 is 56.6 mm×35.8 mm×0.2 mm (height×width×thickness). A size of the diaphragm 3-2 is 46.2 mm×40 mm×0.2 mm (height×width×thickness). A material of the diaphragms is PET and a method for supporting the diaphragms is four sides simple support. Respective shapes of the diaphragms are calculated using following equation (3).

A natural angular frequency for four sides simple support is calculated by following equation (3) (a,b: thickness of side, m,n: integral number representing mode, Do, ρ: natural value of material, h: thickness).

$$\omega = \sqrt{\frac{D_0}{\rho h}}\,\pi^2\left(\left(\frac{m}{a}\right)^2 + \left(\frac{n}{b}\right)^2\right) \tag{3}$$

Accordingly, if a length of each side of the diaphragm 3 is a multiple (same ratio) of any combination among (1/√3, 1/√3, 1/√4, 1/√5, 1/√7 1/√11, . . . ), the model density is raised. In the present design, a size of the diaphragm 3-1 is 0.08 times of (1/√2 (height), 1/√5 (width)), and a size of the diaphragm 3-2 is 0.08 times of (1/√3 (height), 1/√4 (width)).

An installed location of the vibration source 4 is a center of the diaphragm 3, and a size thereof is 5 mm×5 mm. The sound collector 5 is installed at a center of the diaphragm 3 and at a location having height 30 mm from the center.

Figure 4:
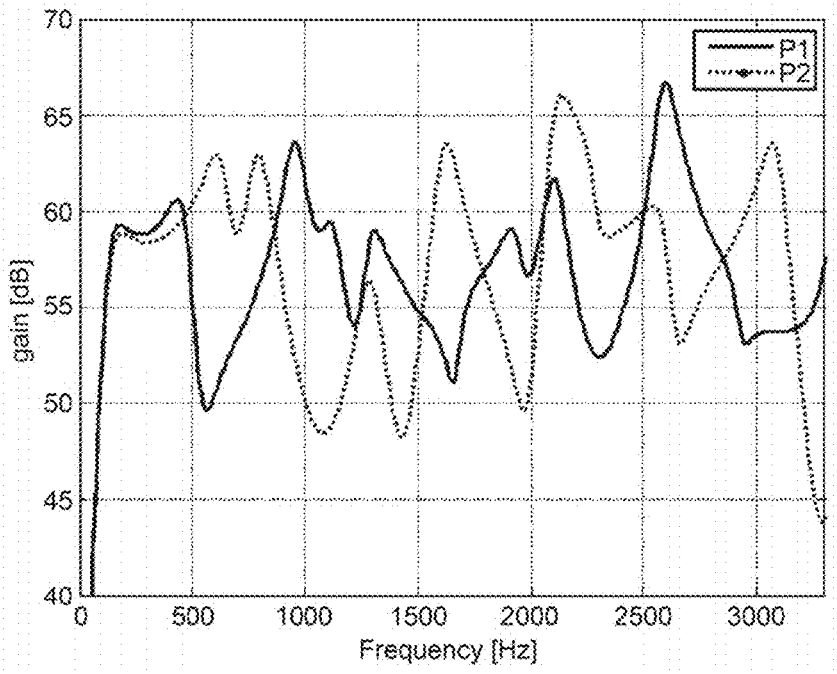
FIG. 4 is a simulation result of transfer characteristics $P_1$ and $P_2$ from diaphragms 3-1 and 3-2 to a sound collector 5 according to the embodiment 1.

FIG. 4 is a simulation result of transfer characteristics $P_1$ and $P_2$ from the diaphragms 3-1 and 3-2 to the sound collector 5. By a suitable design of the diaphragms 3-1 and 3-2, the respective resonances thereof are not nearly overlapped, and they have a complementary relationship.

Figure 5:
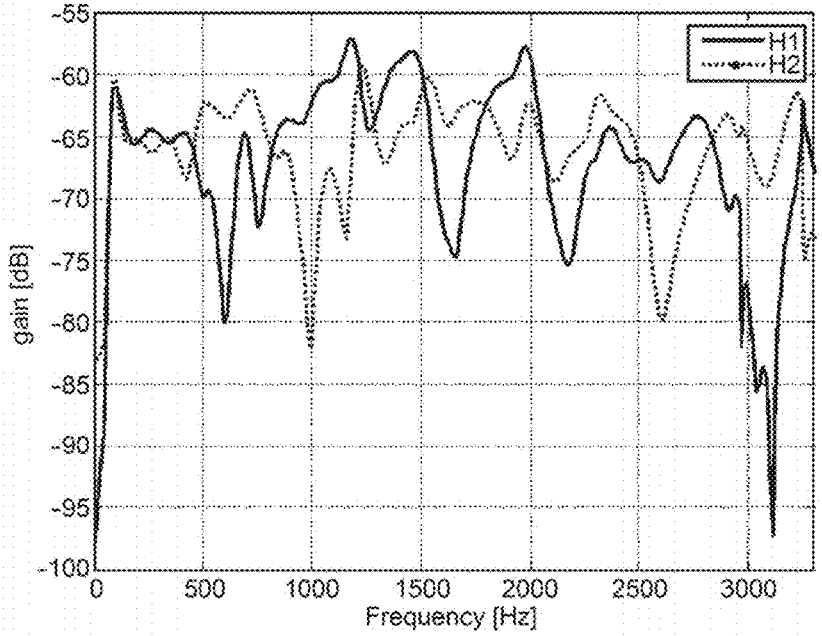
FIG. 5 is a simulation result of transfer characteristics of filters $H_1$ and $H_2$ according to the embodiment 1.

FIG. 5 is a simulation result of filters $H_1$ and $H_2$. In FIG. 4, at a frequency band that a gain of $P_1$ is higher than a gain of $P_2$, a gain of $H_1$ is higher than a gain of $H_2$. At a frequency band that a gain of $P_1$ is lower than a gain of $P_2$, a gain of $H_1$ is lower than a gain of $H_2$. Namely, respective transfer characteristics of the filters $H_1$ and $H_2$ are mutually complemented.

Figure 6:
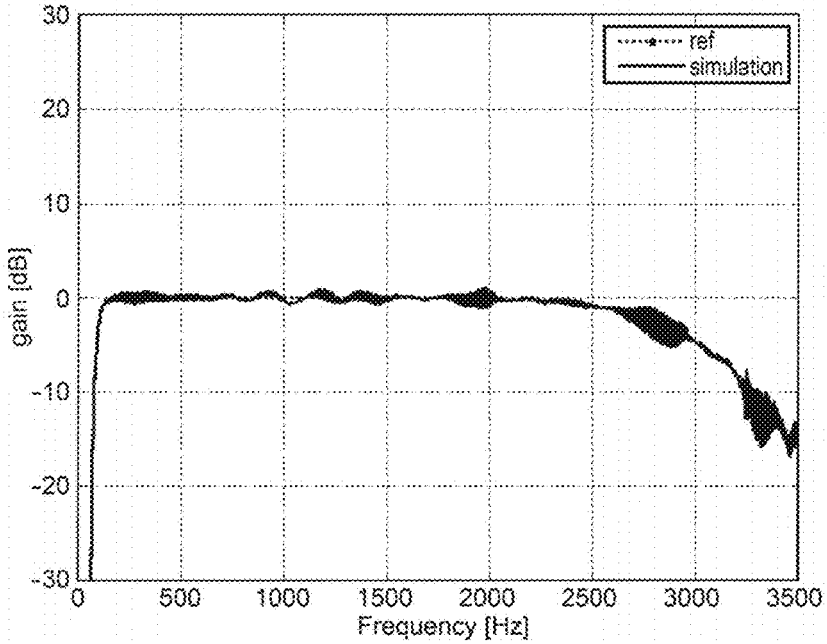
FIG. 6 is a simulation result of a transfer characteristic of a synthetic sound wave at a location of the sound collector 5 according to the embodiment 1.

FIG. 6 is a simulation result of a transfer characteristic of the synthetic sound wave at a location of the sound collector 5 after applying the filter. At a target band (100-2500 Hz), the transfer characteristic is flat similar to the target transfer characteristic (ref in FIG. 6).

Figure 7:
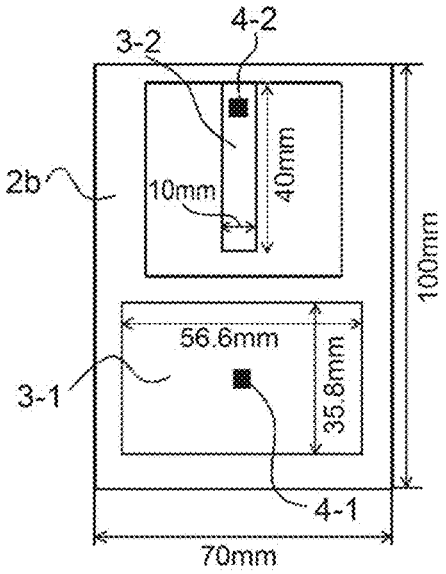
FIG. 7 is a schematic diagram showing a shape of an embodiment 2.

FIG. 7 is an embodiment 2 of the speaker system according to the first embodiment. FIG. 7 shows the speaker system drawn from the back face side. Component of filters and so on are same as those of FIG. 1. Accordingly, they are omitted in FIG. 7.

As the speakers, two diaphragms 3-1 and 3-2 are used. A size of the diaphragm 3-1 is 56.6 mm×35.8 mm×0.2 mm (height×width×thickness). A size of the diaphragm 3-2 is 40 mm×10 mm×0.2 mm (height×width×thickness). A material of the diaphragms is PET and a method for supporting the diaphragm 3-1 is four sides simple support. A method for supporting the diaphragm 3-2 is one side fixation and supported on the back side plate so as to be a cantilever. An installed location of the vibration source 4-1 on the diaphragm 3-1 is a center on the square area shown in FIG. 7. An installed location of the vibration source 4-2 on the diaphragm 3-2 is a center along a lateral direction and a location nearer the fixed edge side along a longitudinal direction. A size of the vibration source 4 is 5 mm×5 mm. The sound collector 5 is installed at a center of the back side plate and a location having a height 30 mm from the center. Furthermore, the diaphragm 3-2 is a cantilever, and the output sound pressure is low. Accordingly, a gain ratio of the vibration source 4 at the diaphragms 3-1 and 3-2 is "1:4" previously.

A natural angular frequency of the cantilever (one side fixation) is represented as following equation (4). Accordingly, the diaphragm 3-2 is designed so that the natural angular frequency thereof and the natural angular frequency of the diaphragm 3-1 (of four sides simple support) have a complementary relationship (a: length of lever, b: width, h: thickness, ρS2: surface density, I: second moment of area).

$$\omega_m = \left(\frac{\lambda_m}{a}\right)^2 \sqrt{\frac{E \cdot 1}{\rho S2}} \tag{4}$$

$$\cosh(\lambda_m)\cos(\lambda_m) + 1 = 0$$

Figure 8:
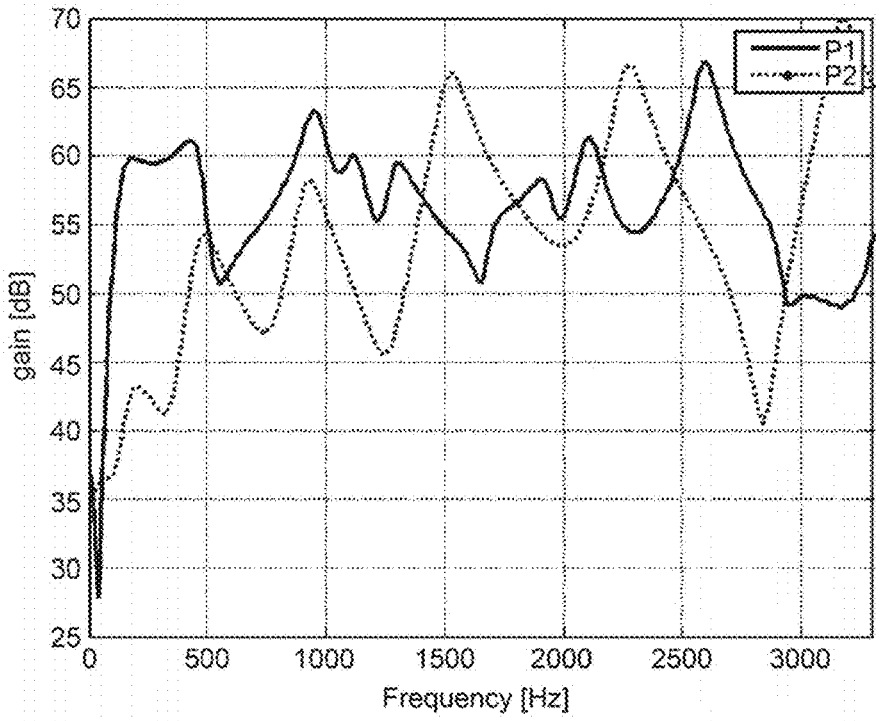
FIG. 8 is a simulation result of transfer characteristics $P_1$ and $P_2$ from diaphragms 3-1 and 3-2 to a sound collector 5 according to the embodiment 2.

FIG. 8 is a simulation result of transfer characteristics $P_1$ and $P_2$ from the diaphragms 3-1 and 3-2 to the sound collector 5. The diaphragms 3-1 and 3-2 are suitably designed. However, in comparison with the embodiment 1, they do not have a complementary relationship.

Figure 9:
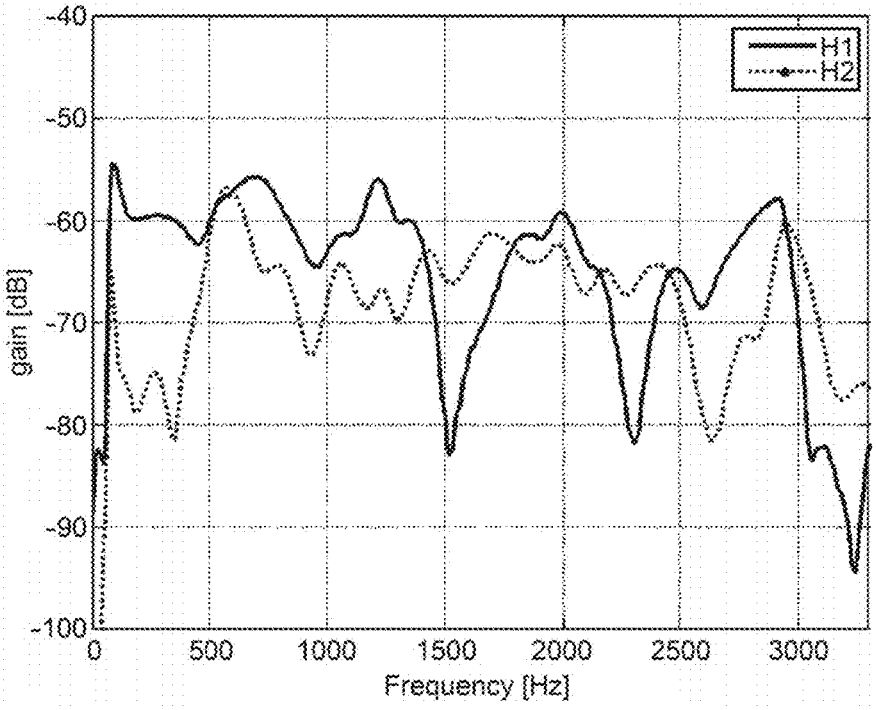
FIG. 9 is a simulation result of transfer characteristics of filters $H_1$ and $H_2$ according to the embodiment 2.

FIG. 9 is a simulation result of transfer characteristics of the filters $H_1$ and $H_2$. In comparison with the embodiment 1, the complementary relationship is not satisfied in the embodiment 2. However, at frequencies around 500 Hz, 1500 Hz and 2300 Hz, it is shown that the diaphragm 3-2 complements the diaphragm 3-1. The reason why the complementary relationship is not satisfied is, a model density of the diaphragm 3-2 itself is low.

Figure 10:
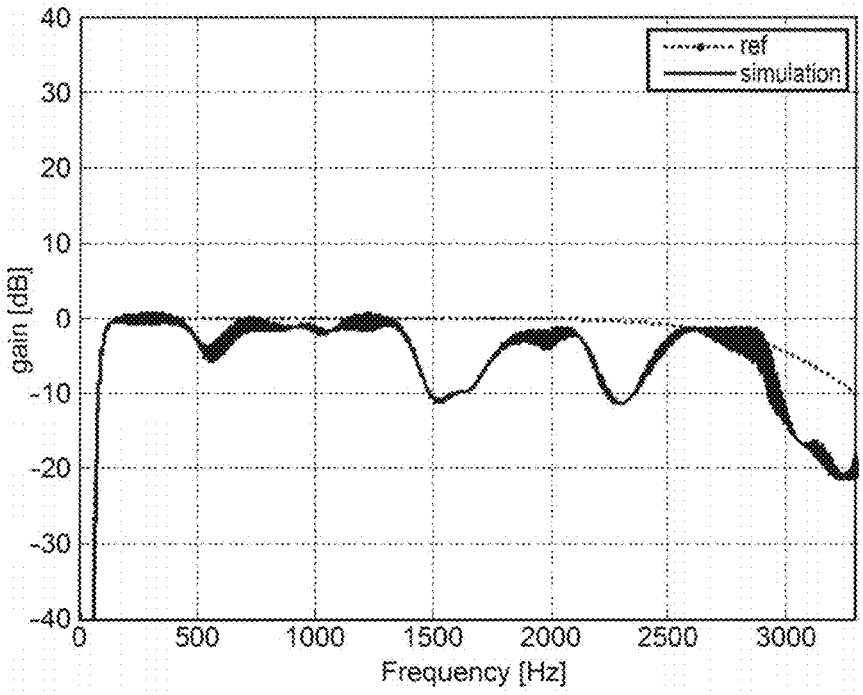
FIG. 10 is a simulation result of a transfer characteristic of a synthetic sound wave at a location of the sound collector 5 according to the embodiment 2.

FIG. 10 is a simulation result of a transfer characteristic of a synthetic sound wave at the sound collector 5 after applying the filter. On the target band (100-2500 Hz), at frequencies around 500 Hz, 1500 Hz and 2300 Hz, the transfer characteristic deviates from the target transfer characteristic (ref in FIG. 10) to −10 dB. This is matched with a notch band of the diaphragm 3-1, which cannot be complemented by the diaphragm 3-2. In the embodiment 1 compared with the embodiment 2, the transfer characteristic at the target band is flat. The embodiment 1 is more preferable as the speaker system.

As another example, a case that the diaphragm 3 has a circular shape can be thought out. If a method for supporting the diaphragm 3 is simply supported, the natural angular frequency thereof is calculated by following equation (5). By using the equation (5), the circular shape can be suitably designed.

$$\omega_{mn} = \frac{\sqrt{T/\rho_s} \cdot \lambda_{mn}}{r_a} \tag{5}$$

$$J_m(k \cdot r_a) = 0,\ k \cdot r_a = \lambda_{mn}$$

From results of the embodiments 1 and 2, a resonance frequency of each diaphragm 3 had better be designed so that a gain difference between transfer characteristics $H_1$ and $H_2$ of filters at the target band is within 20 dB and a difference between input/output characteristic (after applying the filter) and the target transfer characteristic is within 12 dB.

A method for fixing the vibration source 4 with the diaphragm 3 is explained.

Figure 11:
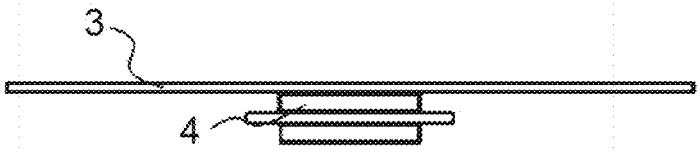
FIG. 11 is one example that a vibration source 4 is stuck on a diaphragm 3.

FIG. 11 is a side-view that the vibration source 4 is stuck at a center of the diaphragm 3, which is the simplest format. As the vibration source 4, a piezoelectric ceramic is used. In order to stick the vibration source 4, all contact surface of the vibration source 4 is adhered on the diaphragm 3 using an adhesive or a double face tape. In this case, a vibration mode of the diaphragm 3 fluctuates from the simulation value largely. Especially, if an area of the diaphragm 3 is small, this fluctuation is remarkable. This reason is, due to effect of the adhesive or the double face tape used for fixation, the diaphragm 3 is dumped, and vibration from the vibration source 4 cannot be effectively transferred to the diaphragm 3. Furthermore, the vibration source 4 and the diaphragm 3 are vibrated with linkage.

Figure 12:
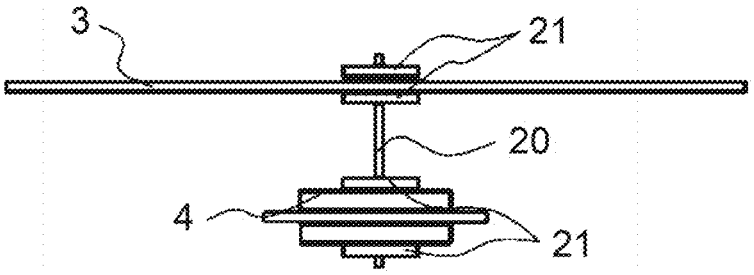
FIG. 12 is one example that the vibration source 4 is stuck on the diaphragm 3 using a bolt 20 and a nut 21.

FIG. 12 is a side-view that the vibration source 4 is stuck on the diaphragm 3 using a bolt 20 and a nut 21. By penetrating a bolt into respective centers of the diaphragm 3 and the vibration source 4, the diaphragm 3 and the vibration source 4 are clamped and fixed by the nut respectively. The diaphragm 3 and the vibration source 4 are fixed at a remote location via the bolt 20. As a result, in comparison with FIG. 11, a central part of the diaphragm 3 can be effectively vibrated, and the vibration mode of the diaphragm 3 approaches the simulation value. Accordingly, a method for fixing the diaphragm 3 and the vibration source 4 is preferably component of FIG. 12.

Figure 13:
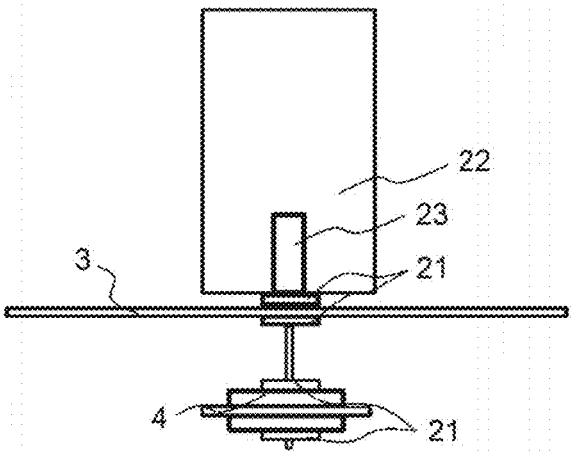
FIG. 13 is one example that a foaming material 22 is attached at a tip of the bolt 20 at a side of the diaphragm 3 in FIG. 12.

FIG. 13 is a side-view that a spacer 23 is installed at a tip of the bolt 20 at a side of the diaphragm 3 in FIG. 12 and a foaming material 22 is attached thereto. If an area of the diaphragm 3 is small, sound pressure having low frequency smaller than 500 Hz is hard to occur. This reason is, in case of the diaphragm having small area, the diaphragm does not vibrate so as to swing the air at low frequency.

At this point, as to the foaming material 22, the acoustic impedance is near the air, and the radiation efficiency is good. Accordingly, the foaming material 22 is suitable as a low band-sound producing material. If the foaming material 22 is stuck on the diaphragm 3 as it is, vibration of the diaphragm 3 is impeded. Accordingly, the foaming material 22 is stuck via the bolt 20 so as to transfer the vibration of the vibration source 4 is transferred to the diaphragm 3 and the foaming material 22 respectively. Furthermore, sound producing efficiency of the foaming material 22 is due to the surface area. Accordingly, a large foaming material 22 as much as possible is preferably attached.

As mentioned-above, according to the first embodiment, by using two diaphragms 3-1 and 3-2 having different shapes, respective transfer characteristics of the diaphragms are designed so as to satisfy the complementary relationship. As a result, a band of one transfer characteristic can be complemented by another transfer characteristic, which is not realized by the one transfer characteristic. Namely, by using filters designed so that a transfer characteristic from the input signal to the output signal is flattened at desired frequency band, a difference between a transfer characteristic of the input signal and a transfer characteristic of the output signal can be reduced.

(Modification 1 of the First Embodiment)

Figure 14A:
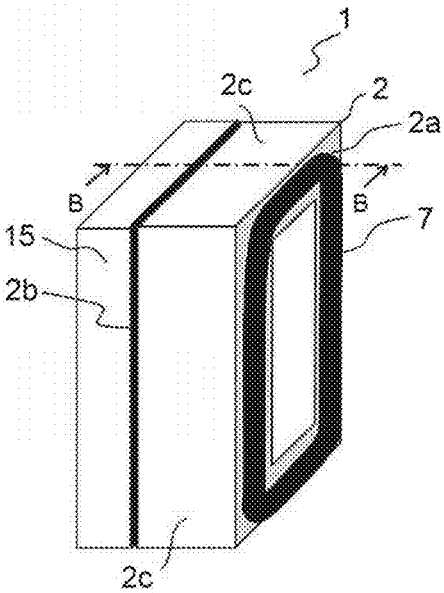
FIGS. 14A and 14B are a perspective diagram and a sectional diagram of the speaker system according to a modification 1 of the first embodiment.
Figure 14B:
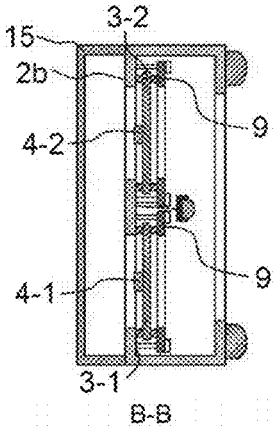

FIGS. 14A and 14B are a perspective diagram and a sectional diagram of the speaker system according to a modification 1 of the first embodiment. Component of filters and so on are same as those of FIG. 1. Accordingly, they are omitted in FIGS. 14A and 14B.

In the modification 1, a cavity 15 is installed in contact with the back face 2*b* so as to cover the vibration source 4 installed on the back face of the diaphragm 3. For example, the cavity 15 seals the diaphragm 3 and the vibration source 4 from the back face 2*b* on which the cavity 15 is attached.

By installing the cavity 15, sound pressure due to baffle effect can be increased. A shape of the cavity 15 is a box type basically. However, the shape may be variously changed, such as a cylinder type or a circle type. Other components of the speaker system are same as those of the speaker system of the first embodiment.

(Modification 2 of the First Embodiment)

Figure 15A:
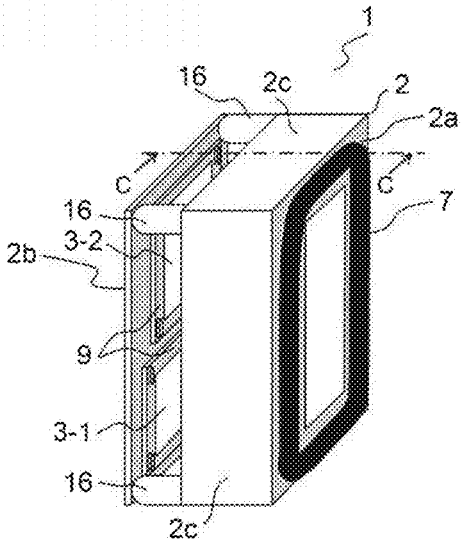
FIGS. 15A and 15B are a perspective diagram and a sectional diagram of the speaker system according to a modification 2 of the first embodiment.
Figure 15B:
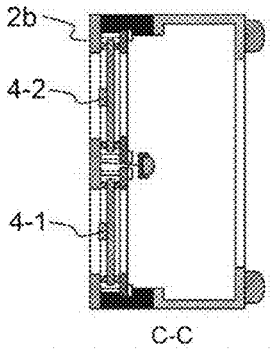

FIGS. 15A and 15B are a perspective diagram and a sectional diagram of the speaker system according to a modification 2 of the first embodiment. Component of filters and so on are same as those of FIG. 1. Accordingly, they are omitted in FIGS. 15A and 15B.

In the modification 2, the back face 2*b* of the package 2 is separated from the side face 2*c*, and a space is set between the back face 2*b* and the side face 2*c*. The back face 2*b* and the side face 2*c* are connected at respective edge parts by a plurality of poles (supports). The number of the poles 16 is the number able to stably fix the back face 2*b*, the side face 2*c* and the front face 2*a*, regularly, four. As a result, in the package in which the listener's ear is inserted, the listener's feeling of sealing can be reduced. Furthermore, the outside speech can be acquired. Other components thereof are same as those of the speaker system of the first embodiment.

The Second Embodiment

Figure 16A:
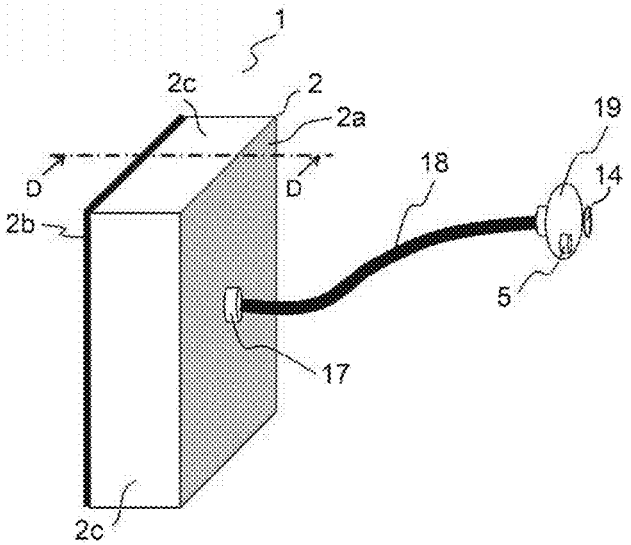
FIGS. 16A and 16B are a perspective diagram and a sectional diagram of a speaker system according to the second embodiment.
Figure 16B:
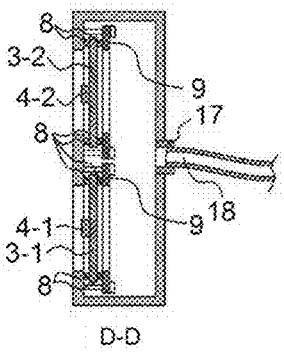

FIGS. 16A and 16B are a perspective diagram and a sectional diagram of a speaker system according to the second embodiment. Component of filters and so on are same as those of the first embodiment. Accordingly, they are omitted in FIGS. 16A and 16B In the second embodiment, the opening of the front face 2*a* of the package is omitted, and a tube connector 17 is set instead of the opening. A tube 18 is installed onto the tube connector 17 and transmits a sound wave to the listener's external auditory canal. At a tip of the external auditory side of the tube 18, an auricular insertion part 19 may be set. The auricular insertion part 19 includes an ear phone and so on. At the tip of the tube 18, an ear muff to cover the ear may be set instead of the auricular insertion part 19.

The tube 18 means a hollow tube able to transmit the sound wave. As the tube 18, for example, a softy tube formed by a flexible material such as a resin may be used. If the tube 18 is formed by non-magnetic material, the speaker system of the second embodiment can be used in the strong magnetic field environment such as MRI device.

If the speaker system of the second embodiment is used for ANC, the sound collector 5 is installed adjacent to the auricular insertion part 19. In this case, an entrance of the auricular is a position to output the sound wave.

In the second embodiment, different from the first embodiment, as to the back face 2*b*, a size attachable to the listener's ear need not be taken into consideration. Accordingly, in case of using two diaphragms 3 having different vibration characteristics, a size of the diaphragm 3 can be increased. As a result, the sound having lower frequency can be effectively output.

Figure 17:
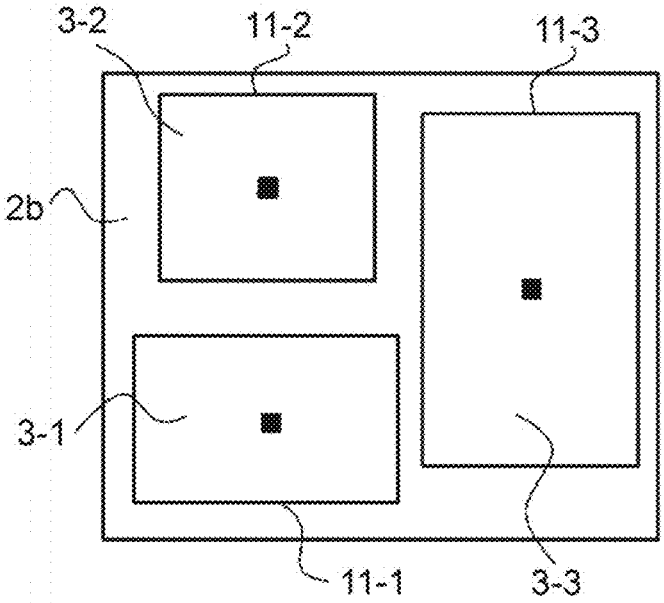
FIG. 17 is a schematic diagram of three diaphragms 3 (having different shapes) supported on the back face 2*b*.

FIG. 17 is a schematic diagram of three diaphragms 3-1, 3-2 and 3-3 (having respective different shapes). In FIG. 17, the speaker system 1 is viewed from the back face side, and components such as filters and so on are not shown.

In this case, the filter 12 to acquire the target transfer characteristic D is designed by following equation (6).

$$P_1 \cdot H_1 + P_2 \cdot H_2 + P_3 \cdot H_3 = D \quad (6)$$

Here, $H_1$, $H_2$ and $H_3$ represent respective transfer characteristics of filters 12-1, 12-2 and 12-3. $P_1$, $P_2$ and $P_3$ represent respective transfer characteristics from each speaker 11-1, 11-2 and 11-3 to the sound collector 5. D represents a target transfer characteristic from the input signal to the output signal (i.e., a sound pressure of a synthetic sound wave at the sound collector 5). The transfer characteristics P1, P2 and P3 are previously measured.

In this way, by using diaphragms 3-1, 3-2 and 3-3 having respective different shapes, MINT can be applied more easily.

Figure 18:
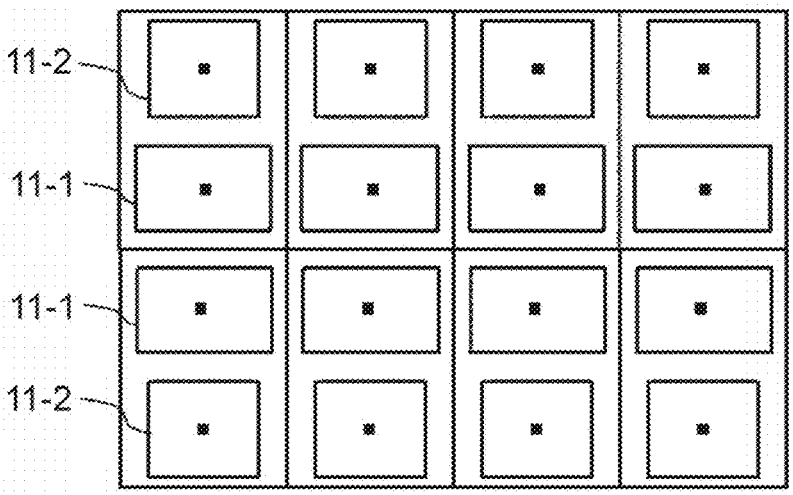
FIG. 18 is one example that a plurality of speaker systems of the second embodiment is aligned.

FIG. 18 is one example that a plurality of speaker systems of the second embodiment is aligned. By using the plurality of speaker systems, the sound pressure can be increased. For example, in FIG. 18, eight speaker systems are used. Accordingly, increase "18 dB" is estimated (6 log 2N, N=the number of speaker systems).

Furthermore, the diaphragm 3 used for this case has two kinds of diaphragms 3-1 and 3-2. Accordingly, two kinds of filters 12-1 and 12-2 are applied. The transfer characteristics $P_1$ and $P_2$ to derive the filters 12-1 and 12-2 are transfer characteristics from respective diaphragms 3 (respective speakers 11) to the sound collector 5. The filters 12-1 and 12-2 are designed so as to satisfy the equation (1).

Figure 19A:
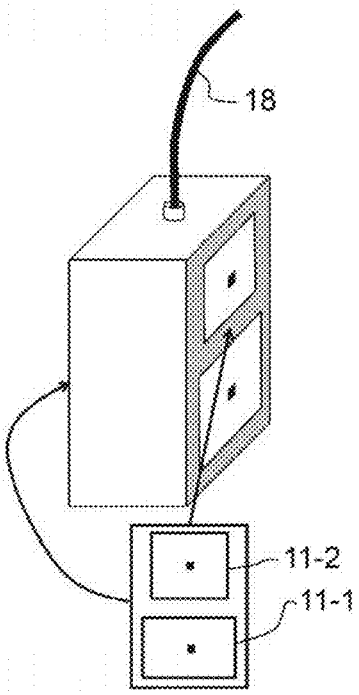
FIGS. 19A and 19B are perspective diagrams of a speaker system having a plurality of speakers installed three-dimensionally.
Figure 19B:
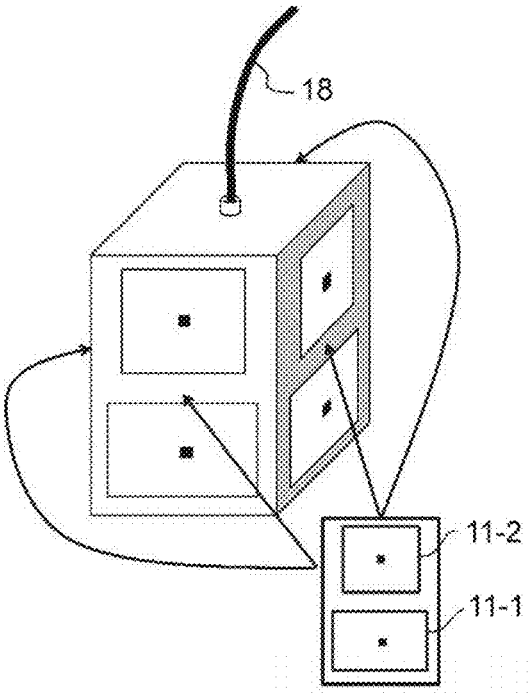

FIGS. 19A and 19B are a speaker system that two speakers 11-1 and 11-2 (installed on the back face 2*b*) are located three-dimensionally. FIG. 19A shows the case that two speaker systems are located at opposite faces of hexahedron (square pole). FIG. 19B shows the case that four speaker systems are located at respective side faces of hexahedron (square pole). One end of the tube 18 is connected to a center of the hexahedron.

As shown in FIG. 18, if a plurality of speaker systems is simply aligned on a plain, respective difference from each speaker 11 to the sound collector are different, and effect of increase of sound pressure is reduced. However, in component of FIG. 19, respective difference from each speaker 11 to the sound collector is equal. Accordingly, the estimated effect of increase of sound pressure can be accomplished.

In FIG. 19, the shape is a square pole. However, the shape may be a polygonal column. Furthermore, in order to prevent resonance or excitation, an acoustic material may be put therein.

The Third Embodiment

In the third embodiment, a shape of the package 30 (to be used in MRI device) for the listener's ear is explained.

Figure 20:
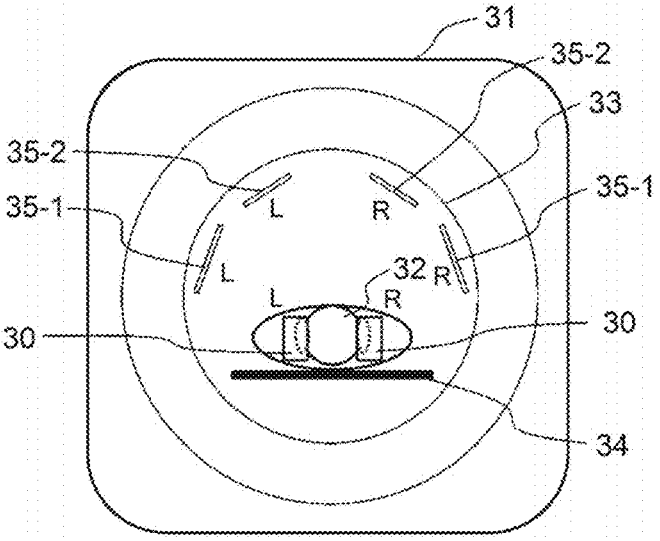
FIG. 20 is a schematic diagram of MRI device 31.

FIG. 20 is a simple component of MRI device 31. MRI device 31 includes a bore 33 of cylinder type (to enter a test subject 32) and a bed 34. The test subject 32 lying down on the bed 34 is inspected.

The speaker systems of the first and second embodiments are used in above-mentioned MRI device. Furthermore, by installing the diaphragm 3 into MRI device, the speaker system is expected to be functioning as ANC to protect noise in MRI device.

In the third embodiment, for example, in the bore 33 of MRI device 31, two pairs of speakers 35-1 and 35-2 having two different shapes are installed for right and left ears. The speaker 35 is composed by a diaphragm and a vibration source. Respective shapes of diaphragms of two speakers 35-1 and 35-2 are different. As the vibration source, a piezoelectric element such as a piezo speaker is preferably used.

By the sound collector 5 installed into the package 30 covering the test subject's ear, above-mentioned filters 12-1 and 12-2 are adjusted. In FIG. 20, L represents the left side and R represents the right side. Component of filters and so on are same as those of FIG. 1. Accordingly, they are omitted in FIG. 20.

As a method for aligning speakers 35, except for the method for aligning along a circumference direction of the bore 33, the method for aligning along a depth direction of the bore or the method for aligning at an edge face of the bore may be used. Furthermore, the number of speakers 35 may be larger than (or equal to) two. If two speakers 35-1 and 35-2 having different shapes are one pair, when N pairs thereof are aligned, sound increasing of "6 log 2N[dB]" is estimated.

A location of the sound collector 5 is important for MRI device. If non-magnetic material microphone (such as an optical microphone) is used as the sound collector 5, it is preferably installed near an entrance of the external auditory canal. The optical microphone is expensive. Accordingly, a microphone (such as MEMS microphone) not including a magnetic material is preferably used. In case of using HEMS microphone, the influence occurs on MRI image. Accordingly, this microphone needs to be separated as 1~3 cm from the entrance of the external auditory canal.

Figure 21A:
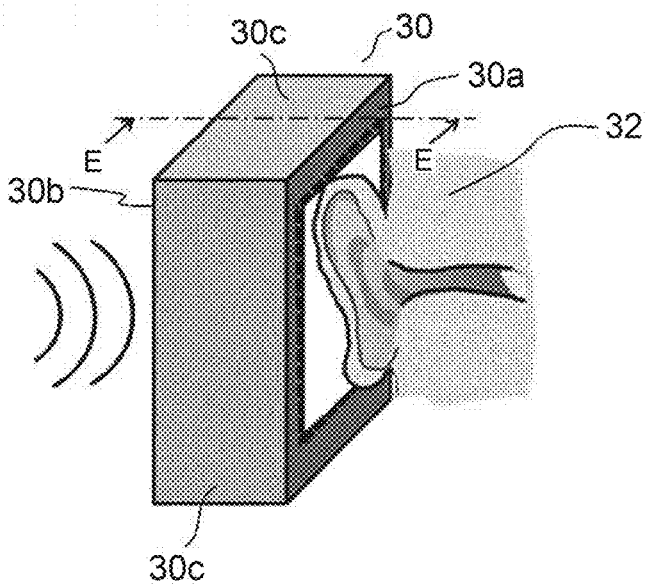
FIGS. 21A and 21B are a perspective diagram and a sectional diagram of a package 30.
Figure 21B:
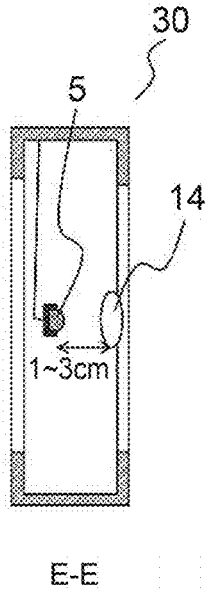

FIGS. 21A and 21B are a perspective diagram and a sectional diagram of the package 30 having openings at the front face 30*a* and the back face 30*b*. In case of the package including the opening, the sound collector 5 is preferably installed at a location separated from the entrance of the external auditory canal along a direction toward the back face 30*b*. However, if a depth of the package is short or if a section of the opening is large, a sound wave from a control sound source does not become a plane wave sufficiently. Accordingly, at the microphone to be separated around 3 cm, plane wave-interference cannot be effectively used, and noise reduction of high frequency larger than (or equal to) 1.5 kHz cannot be expected. In order to avoid this problem, it is thought out that a slit or a rib is formed inside the package 30.

Hereafter, as to shape of the package 30, detail principle is explained. In the package 30, in order for the test subject (wearing the package) to remove a feeling of pressure or to easily hear the external sound, an entrance or an opening of the sound is preferably prepared. However, if the opening is too large, a sound pressure (to be transferred to the package 30) from a control sound source further drops, the sound pressure largely drops than a sound pressure (entering into the package 30) of a noise source of a control target, and sound pressure-interference by ANC cannot be performed. Accordingly, if the package 30 includes the opening, by installing a reflector (such as a rib) around the opening and by lowering the averaged sound absorption ratio, sound increasing is preferably attempted.

In general, the sound pressure inside the package 30 is in proportion to the averaged sound absorption ratio. A product of air-damping and spatial resonance frequency in enclosed region is represented as an equation (7). Here, c is a sound velocity, S is a surface area of the package, α is an averaged sound absorption ratio, and V is a housing capacity.

$$\xi_r \cdot \omega_r = \frac{cS\alpha}{8V} \tag{7}$$

The averaged sound absorption ratio α is defined by an equation (8). Specifically, a product of a sound absorption ratio $\alpha_i$ (determined by a material of an inner wall of the package (viewed from the inside of the package to the outside)) and an installation area $S_i$ of the material is divided by a housing surface area S.

$$\alpha = \frac{\sum_{i=1}^{N} (\alpha_i \cdot S_i)}{S} \tag{8}$$

In order to simplify, a rectangular parallelepiped is explained as an example. If all six faces (N=6) have the sound absorption ratio $\alpha_1$, the averaged sound absorption ratio α is equal to $\alpha_1$. If all six faces are openings, reflection does not occur in the opening (viewed from the inside to the outside), and the sound absorption ratio is 1. By above-mentioned reason, if the opening is always necessary for one face and if other faces do not absorb sound as much as possible, increasing of the averaged sound absorption ratio can be suppressed.

Accordingly, at the opening except for the side wall, to the extent so as not to disturb flow of sound wave, a plurality of partitions is preferably installed. Furthermore, if the partitions are installed at an interval L(m) and at a length d(m) along a direction of the sound source arriving, in space surrounded by the partitions, the sound wave is changed to a plane wave at a frequency smaller than (or equal to) f(Hz) defined by an equation (9).

$$L \leq \frac{c}{2f} \leq d \text{ (c: sound velocity)} \tag{9}$$

Except for build-up effect, by aligning respective phases of wave surfaces of advancing sound waves (rectifying effect), reduction of the sound pressure can be performed by phase-interference. For example, if a range to set the plane wave is 1500~3500 Hz, it is necessary that d is larger than (or equal to) 0.11 m and L is smaller than (or equal to) 0.05 m. In FIG. 21, if height and width of the opening is 0.1 m, the sound wave having frequency smaller than (or equal to) 1.7 kHz is regarded as the plane wave.

Next, outline of the package 30 using this principle is explained. The package 30 includes a front face 30*a*, a back face 30*b* opposing the front face 30*a*, and a side face 30*c*.

Figure 22A:
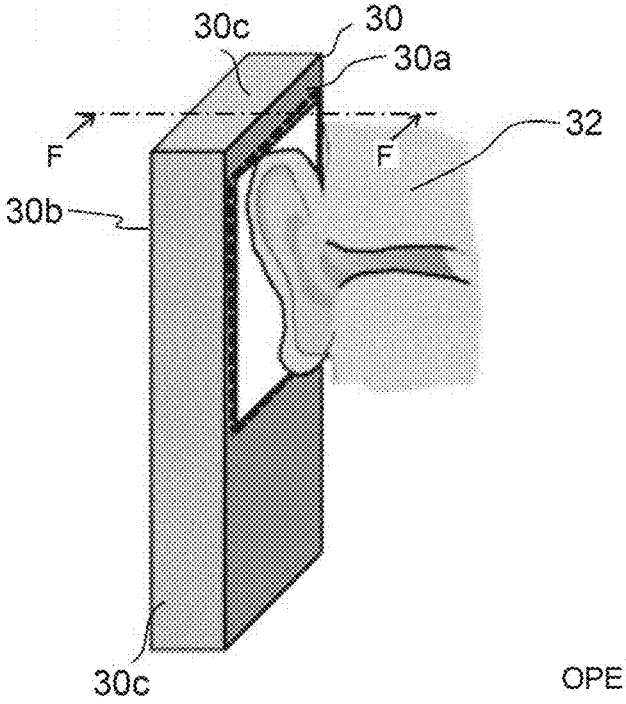
FIGS. 22A and 22B are a perspective diagram and a sectional diagram of the package 30 having an opening on a part of the side face.
Figure 22B:
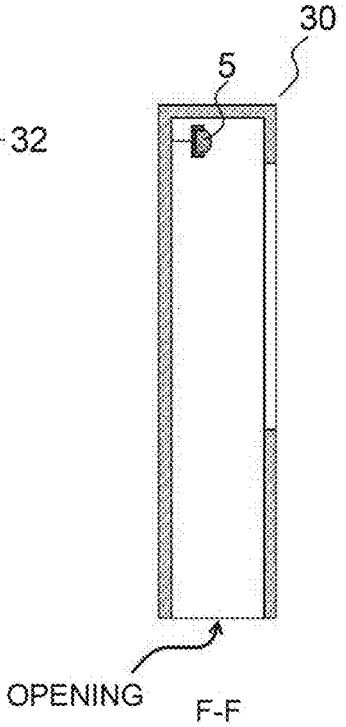
Figure 23A:
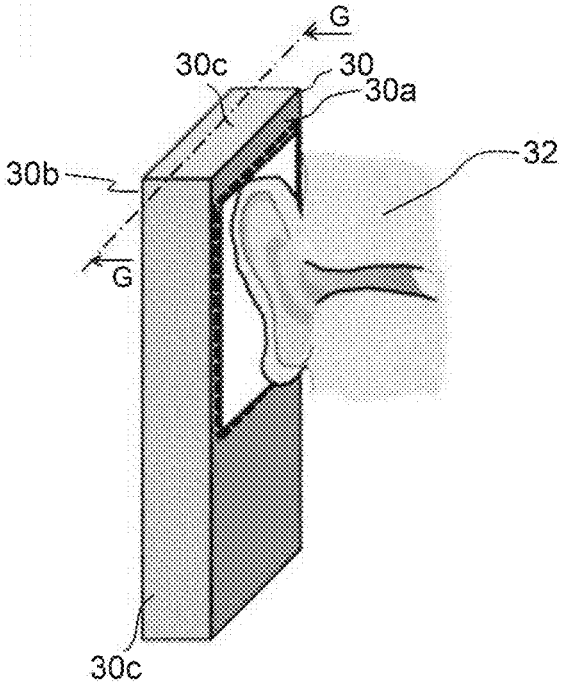
FIGS. 23A and 23B are a perspective diagram and a sectional diagram of the package 30 including partitions.

FIGS. 22A and 22B are a perspective diagram and a sectional diagram of the package 30 having an opening to insert the ear on the front face 30*a* and an opening on a part of the side face 30*c*. In FIG. 23A, a region surrounding the ear is seen as if it is opened. However, actually, it is closed. Accordingly, under a condition that the ear is pushed against the package 30, a part completely opened is an opening of the lower part as a part of the side face 30*b*. The opening does not include partitions. Accordingly, a width of the opening is equivalent to L. In comparison with the case of the opening including partitions, the sound wave is hard to be a plane wave, and a phase of the sound wave propagated is shifted by the arriving direction. Accordingly, under this condition, if a sound wave of the control sound source for sound pressure-interference is radiated from the lower part, arriving direction thereof is shifted from that of a sound wave of the noise source. As a result, even if control by ANC is performed, attenuation effect of the sound pressure cannot be expected around the ear.

Figure 23B:
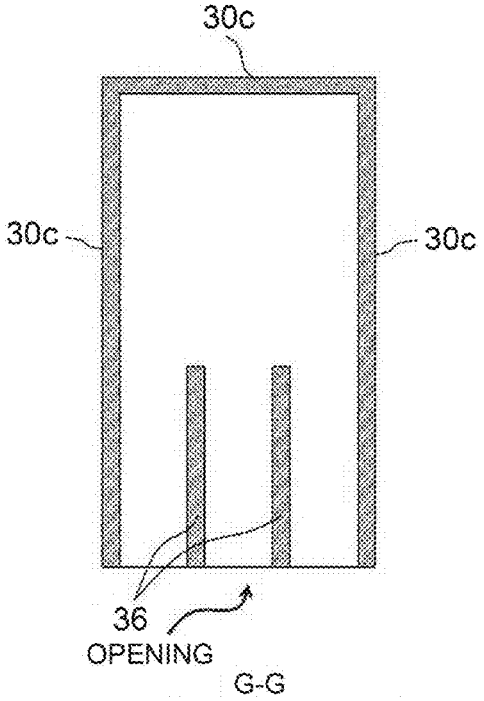

FIGS. 23A and 23B are a perspective diagram and a sectional diagram of the package 30 including partitions 36 at a lower part of the spatial part to insert the ear. In comparison with the shape of FIGS. 21A and 21B, by above-mentioned rectifying effect, during process to propagate the sound wave along the partition 36, it is changed to a plane wave. In the spatial part to insert the ear, the partition 36 cannot be installed basically. However, if the partition 36 is installed into the lower spatial part, the effect is expected. This reason is explained. The sound wave is propagated by diverged into three partitioned spaces (divided by two partitions 36), and respective phases of diverged sound waves are different based on arriving directions thereof. However, in each partitioned space, the sound wave is changed to the plane wave (phases of respective wave surface are matched in the partitioned space). As a result, respective plane waves are approximated to three point sound sources (having different phases) at an end edge of the partition 36, and they are radiated to a space adjacent to the ear. The point radiation approaches the line radiation, and the wave surface also approaches the plane wave. Accordingly, respective sound waves of the control sound source and the noise source are aligned, and the respective sound waves can be interfered at a region of the ear insertion part separated from the partition 36. Especially, at the end edge of the partition 36, by adding the build-up effect due to the reflection effect, sound increasing effect can be also expected.

Figure 24A:
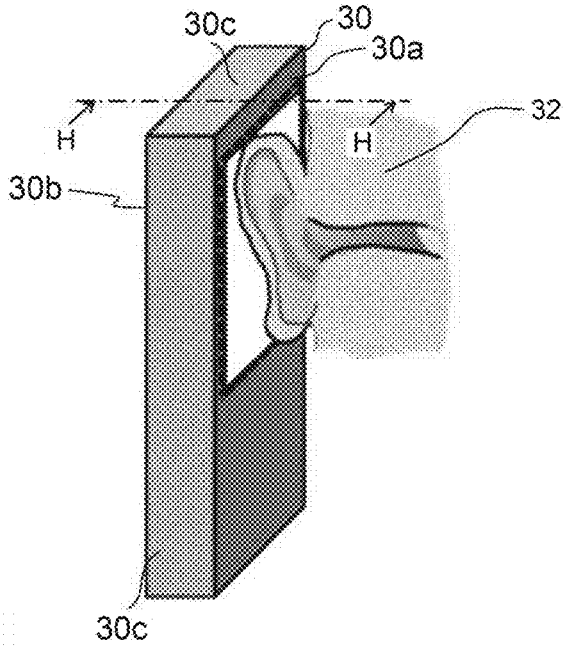
FIGS. 24A and 24B are a perspective diagram and a sectional diagram of the package 30 having an opening on the back face 30*b*.
Figure 24B:
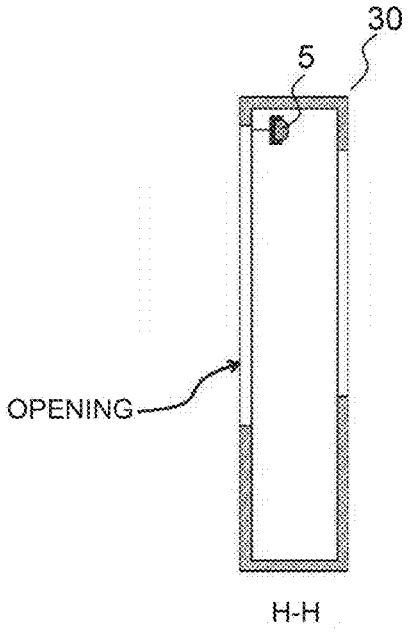

FIGS. 24A and 24B are a perspective diagram and a sectional diagram of the package 30 having an opening (to insert the ear) at the front face 30*a* and an opening at the back face 30*b*. While the listener's ear is inserted into the opening of the package 30, the listener's feeling of pressure is further cancelled.

In this case, the noise source is entered into the package 30 from the opening of back face 30*b*. As mentioned-above, if the partition 36 does not exist, a sound wave of high and middle frequency zone is not changed to a plane wave, and effect of sound wave-interference cannot be expected.

Figure 25A:
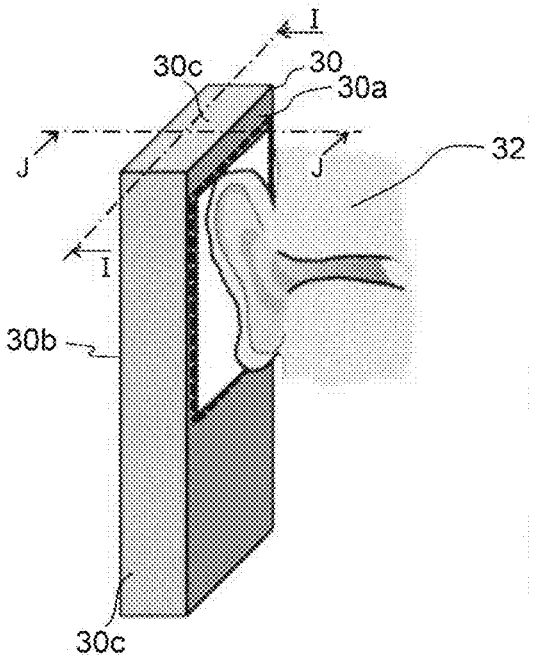
FIGS. 25A~25C are a perspective diagram and a sectional diagram of the package 30 having a rib 37 on the opening of the back face 30*b*.
Figure 25B:
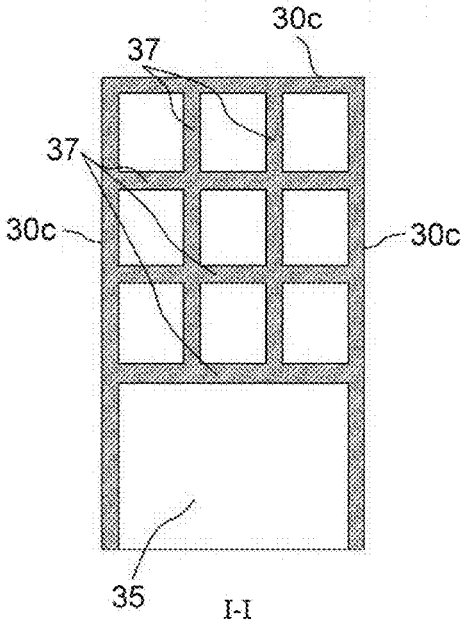
Figure 25C:
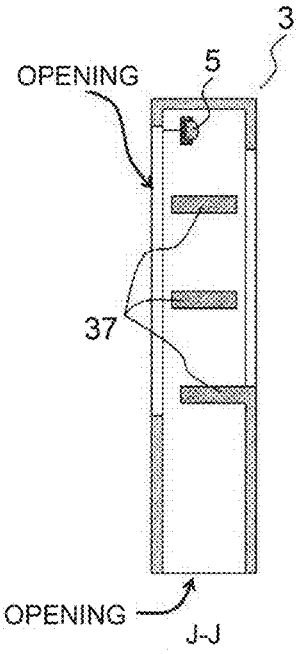
Figure 26A:
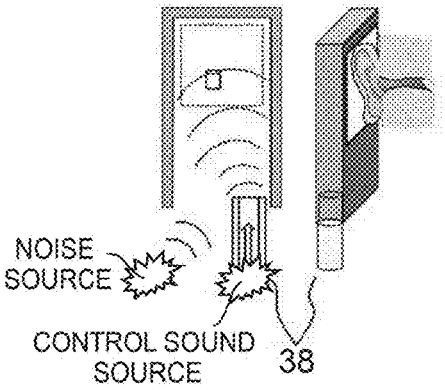
FIGS. 26A~26E are examples that a tube 38 to propagate a sound wave is installed at respective packages of FIGS. 22~25.
Figure 26B:
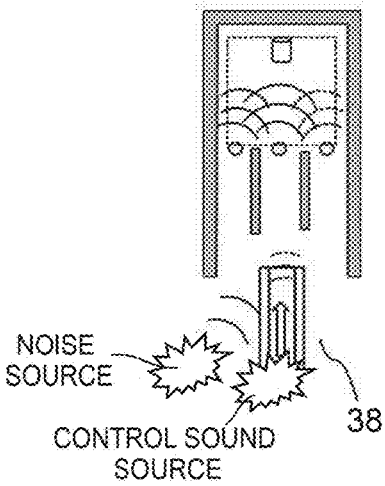
Figure 26C:
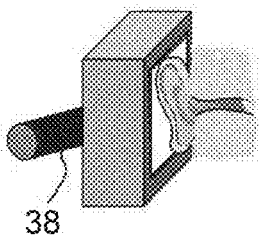
Figure 26D:
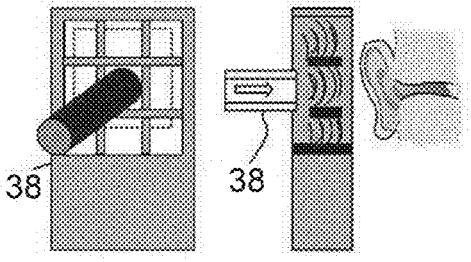
Figure 26E:
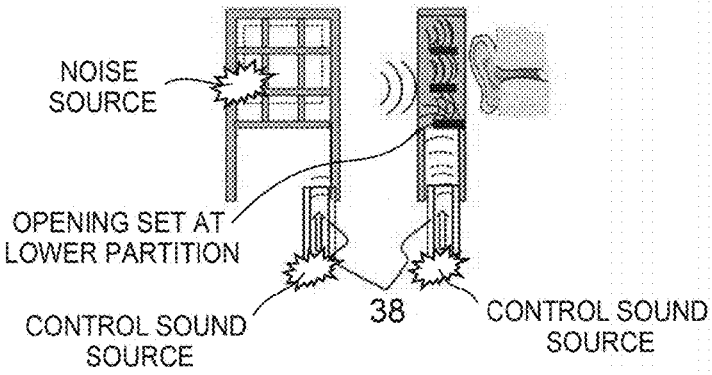

FIGS. 25A~25C are a perspective diagram and a sectional diagram of the package 30 having a rib 37 on the opening of the back face 30*b*. By installing the rib 37, a region of the plane wave is enlarged, and the sound increasing effect by the build-up effect can be expected. On the other hand, by radiating the control sound source from this opening, the sound pressure-interference can be also performed. However, in this method, in order to increase effect of sound wave-interference and to prevent contact between the ear and the rib 37, a depth of the side face needs to be longer. As a result, a size of the package 30 becomes larger, which is demerit.

In order to remove this demerit, if a space for installation does not exist, a sound wave from the control sound source is inserted into the opening of a lower part of the side face 3*c*. In this case, at a bottom stair of the rib 37, an opening to take in a sound wave of the control sound source (entered from the lower part) is formed. The sound wave of the control sound source from this opening is propagated to the rib 37 in order, and approaches to a plane wave by rectifying effect. Here, in comparison with the partition 36 of FIG. 23, a length of the rib 37 is shorter, and the sound wave does not become the plane wave completely. However, the ear is near the rib 37. Accordingly, even if phases thereof are not aligned at an end edge of the rib 37, the interference effect can be expected.

FIGS. 26A~26E are examples that a tube 38 to propagate a sound wave of the control sound source from the diaphragm 3 is put in front of the entrance of the partition 36 of the package 30 shown in FIGS. 22, 23, 24 and 25. A location and a shape of the sound collector 5 are same as above-mentioned one. As a material of the tube 38, a flexible material having the sound absorption effect not so high is used.

For example, a polyethylene tube is good. As a merit to use the tube 38, a radiation face of the control sound wave is a section of the tube. Accordingly, the radiation effect is low, the sound wave is not propagated except for the control area, and unnecessary area of sound increasing does not occur at ANC. Furthermore, in case of ANC for right and left ears, effect of crosstalk need not be taken into consideration and the control calculation-amount is reduced.

In the second embodiment, two diaphragms 3 having different shapes are installed into the same package, and the sound wave therefrom is transmitted by the tube 18. However, respective diaphragms 3 may be installed into different packages (not the same package). Furthermore, as respective lengths of the tube 18 and the tube 38, by shifting pipeline resonances thereof, they are preferably determined so as to easily accomplish the faithful reproduction.

Figure 27:
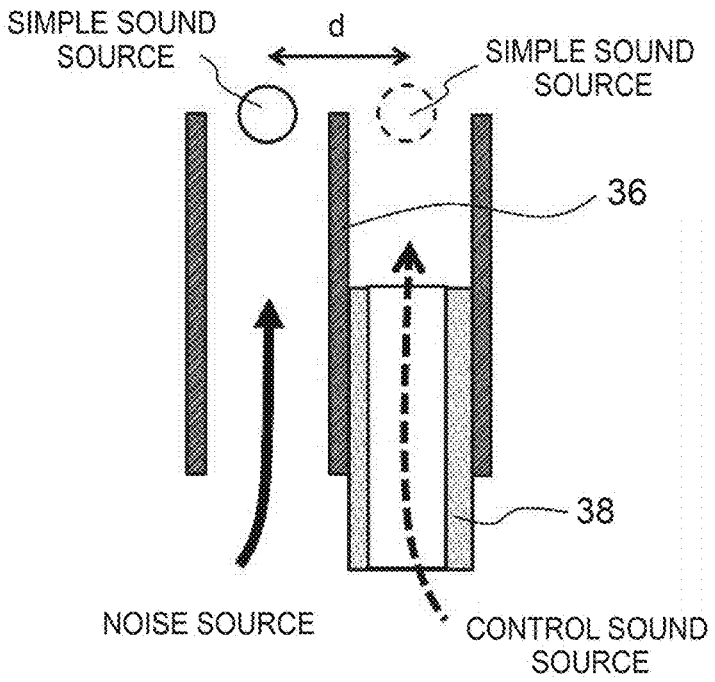
FIG. 27 is one example that the package 30 including one partition 36.

Furthermore, modifications of the partition 36 are shown hereafter,

FIG. 27 is one example that the package 30 including one partition 36. As shown in FIG. 27, among two transmission paths of sound wave (formed by the partition 36), a sound wave from the control sound source is transmitted into one transmission path, and a sound wave from the noise source is transmitted into another transmission path. By the rectifying effect of the partition 36, respective sound waves are propagated as the plane wave. As a result, respective plane waves are approximated to a point sound source at an outlet of the partition 36, they are interfered between two point sound sources, and the radiation acoustic power is reduced.

Attenuation (reduction amount) η of the radiation acoustic power is determined by a distance between two point sound sources and calculated by following equation (10).

$$\eta = 10\log\left(1 - \left(\frac{\sin kd}{kd}\right)^2\right)\text{dB} \tag{10}$$

As shown in the equation (10), the attenuation of the radiation acoustic power is changed by a product of a wave length k and the distance d.

Figure 28:
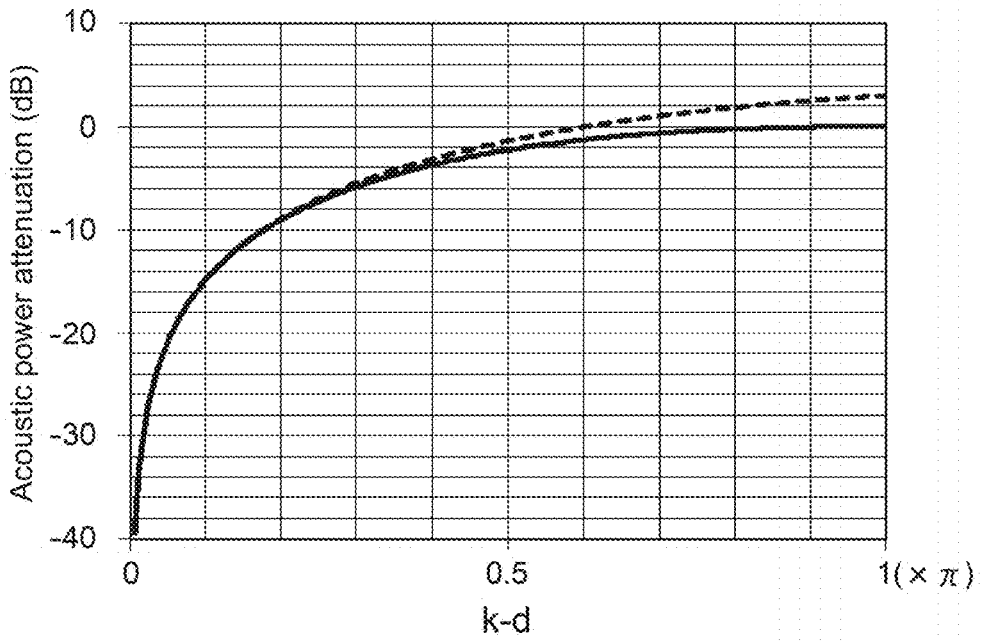
FIG. 28 is a graph showing attenuation of the acoustic power.

FIG. 28 is a graph that the product of the wave length k and the distance d is represented as a horizontal axis and the attenuation of the radiation acoustic power is represented as a vertical axis. In FIG. 28, a solid line represents a theoretical limitation of this effect.

Accordingly, at a range smaller than "kd=π/2", i.e., "d<λ/4", the acoustic power begins to lower. In order to lower to the extent of 10 dB, "d<λ/4" is preferred.

Accordingly, by designing a shape of the partition 36, it is effective to shorten the distance between two point sound sources as much as possible.

Figure 29A:
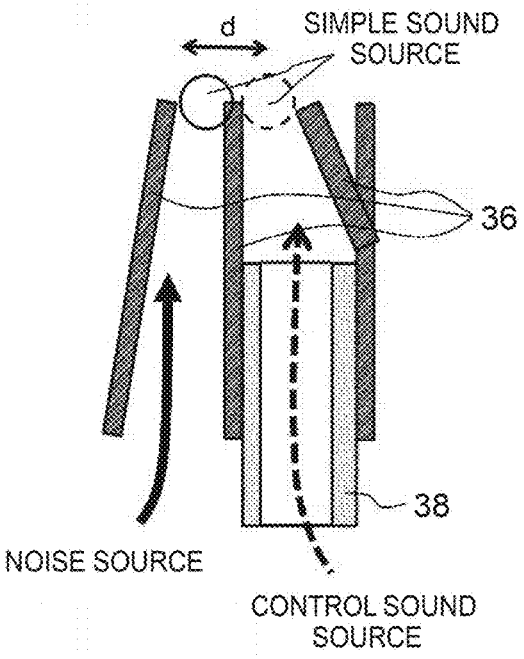
FIGS. 29A and 29B are examples that the package 30 including a guide and an opening at the partition 36.
Figure 29B:
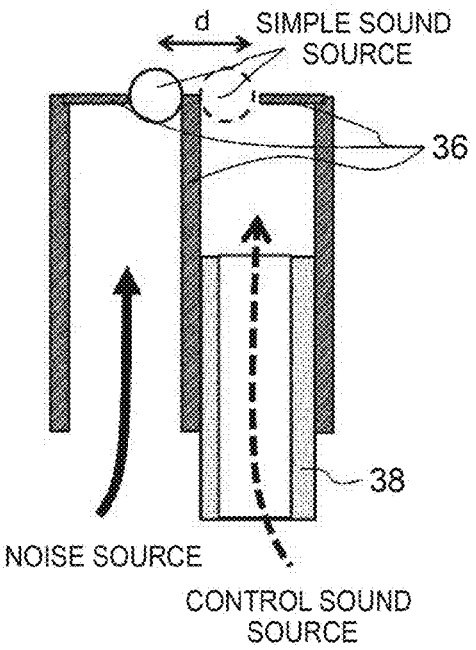

FIGS. 29A and 29B are examples that a guide or an opening is installed at the partition 36. The tube 38 to transmit a sound wave from the control sound source may be near the noise source. Furthermore, the guide may be installed by the same material as the partition 36.

Figure 30:
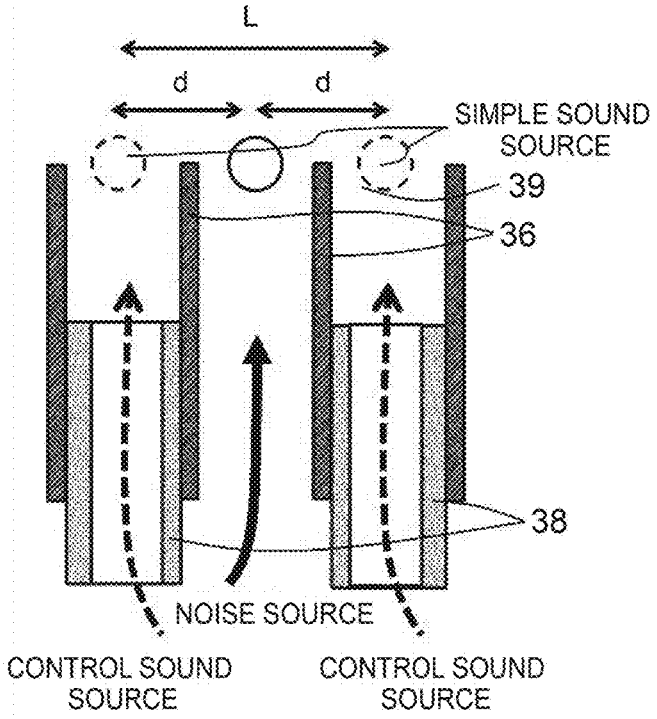
FIG. 30 is one example that the package 30 including a control microphone 39 installed at a center between two control sound sources.

FIG. 30 is one example that a control microphone 39 is located at a center between two control sound sources.

If two point sound sources are located adjacently, as shown in FIG. 30, the control microphone 39 is located at a center line between two point sound sources. By controlling the sound pressure by this control microphone 39, the acoustic power can be reduced at not only this position but also all surroundings.

This attenuation is represented by following equation (11). In FIG. 28, the attenuation is represented as a broken line.

$$\eta = 10\log\left(2\left(1 - \frac{\sin kd}{kd}\right)\right)\text{dB} \tag{11}$$

In this way, the attenuation of acoustic power can approximate the above-mentioned theoretical limitation.

If such counterplan to shorten the distance between point sound sources cannot be performed physically, as shown in FIG. 30, it is effective to install two partitions for control sound sources.

However, as to these control sound sources, it is assumption that the amplitude and the phase characteristic thereof are same respectively. Accordingly, if respective sound waves from the control sound sources are transmitted via the tubes 38, this case needs to take care, such that lengths of the respective tubes are equally set.

If sound waves of the noise source and the control sound source are inputted to different transmission paths (formed by respective partitions), attenuation η of acoustic power is calculated by following equation (12). In the equation (12), "d" is an interval between the noise source and the control sound source, and "L" is a distance between two control sound sources.

$$\eta = 10\log\left(\frac{3}{2} + \frac{1}{2}\frac{\sin kL}{kL} - 2\frac{\sin kd}{kd}\right) \tag{12}$$

Figure 31:
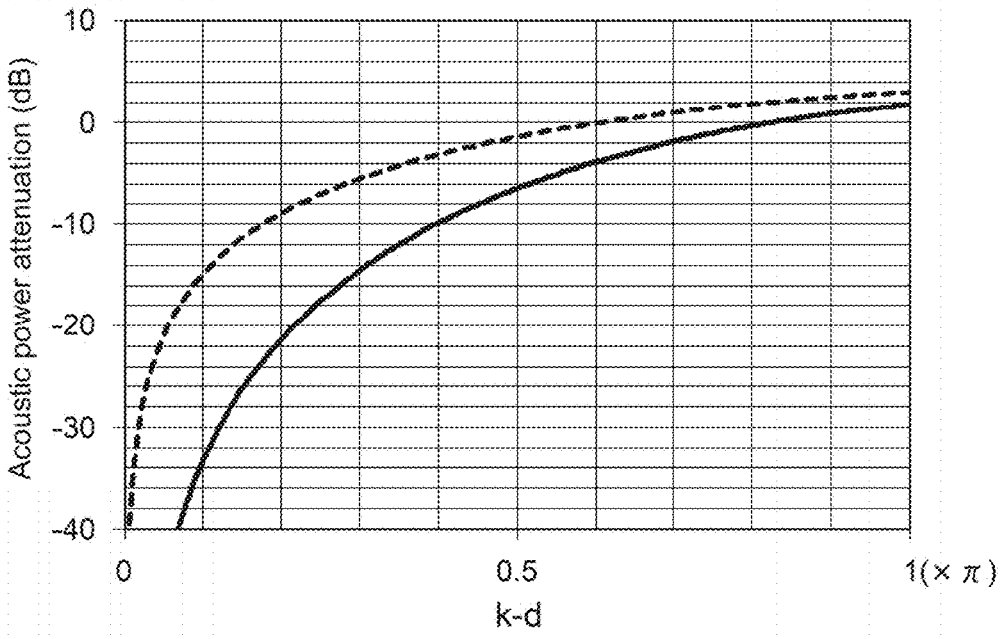
FIG. 31 is a graph showing attenuation effect of the acoustic power.

FIG. 31 is a graph showing attenuation effect of acoustic power for this case. As shown in FIG. 31, the attenuation effect of acoustic power is represented as a solid line. In comparison with attenuation effect of FIG. 28 (in case of one control sound source), the attenuation effect of FIG. 31 is clearly improved.

Figure 32A:
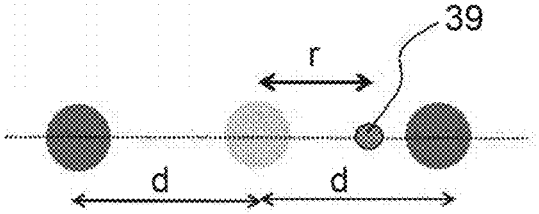
FIGS. 32A and 32B are schematic diagrams showing installed location of the control microphone 39.
Figure 32B:
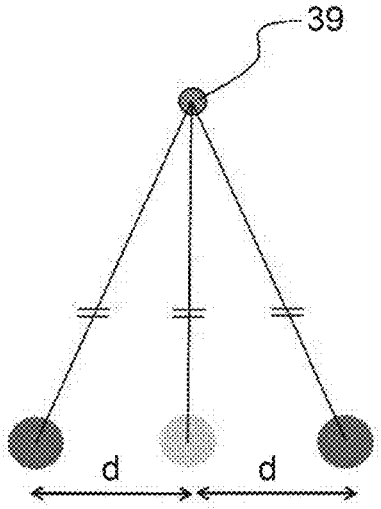

FIGS. 32A and 32B are schematic diagrams showing installed location of the control microphone 39. As shown in FIG. 32A, if the control microphone 39 is located along a center axis passing through two control sound sources, as represented by an equation (13), the control microphone 39 is located at a distance "r" along a distance "d" between the noise source and the control sound source. By this location, the attenuation effect improves.

$$r = \frac{-1+\sqrt{5}}{2}d \cong 0.6d \tag{13}$$

Furthermore, if the control microphone 39 cannot be located along the center axis passing through two control sound sources, the control microphone 39 is located at one peak of an isosceles triangle formed by two control sound sources and the control microphone. By this location, the attenuation effect improves. Especially, if the control microphone is located farther from the control sound source, the attenuation effect more improves.

Figure 33:
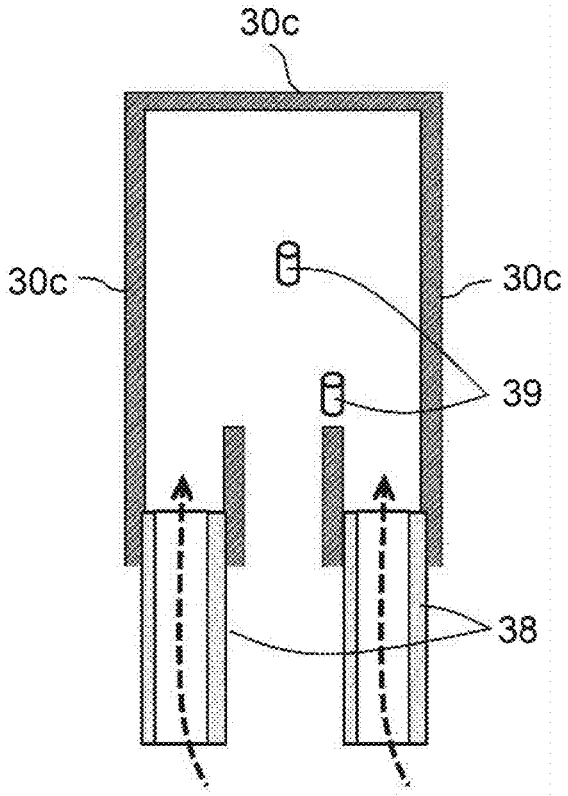
FIG. 33 is a schematic diagram showing installed location of the control microphone 39 in the package.

FIG. 33 is a schematic diagram showing installed location of the control microphone 39. By installing the control microphone 39 at this location and by controlling the sound pressure, due to installation effect of the partition 36, a sound radiated from an end edge of the partition 36 can be reduced (from the radiation source).

While certain embodiments have been described, these embodiments have been presented by way of examples only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A speaker system, comprising:

a plurality of filters that filter a first signal to generate a plurality of second signals; and a plurality of speakers that convert the second signals into sound waves, each speaker having a diaphragm and a vibration source installed in the diaphragm, diaphragms of the speakers having at least two different shapes, wherein a length of each side of the diaphragms is a multiple of any combination among (1/√2, 1/√3, 1/√4, 1/√5, 1/√7, 1/√11), each side of the diaphragms has a same ratio of the combination, respective transfer characteristics of the diaphragms are different from each other, and each filter corresponding to the respective transfer characteristics is set such that a transfer characteristic of a synthetic sound wave of the sound waves approaches a target transfer characteristic.

2. The speaker system according to claim 1, further comprising:

a package including a front face and a back face opposing the front face wherein the diaphragms are located on the back face.

3. The speaker system according to claim 2, further comprising:

a cushion located around an opening of the front face.

4. The speaker system according to claim 2, wherein the package includes a connector and a tube having one end connected to the connector.

5. The speaker system according to claim 4, wherein the other end of the tube includes an auricular insertion part.

6. The speaker system according to claim 2, further comprising:

a cavity in contact with the back face, that covers the vibration source.

7. The speaker system according to claim 1, wherein the vibration source is a piezoelectric element.

8. The speaker system according to claim 1, wherein the target transfer characteristic includes a flat transfer characteristic at a frequency band larger than 100 Hz and smaller than 20 kHz in case of musical piece playback, a flat transfer characteristic at a frequency band larger than 100 Hz and smaller than 5 kHz in case of sound reproduction, and a flat transfer characteristic at a frequency band larger than 100 Hz and smaller than 3.5 kHz in case of active noise control.

9. The speaker system according to claim 1, further comprising:

a sound collector that synthesizes the sound waves to generate the synthetic sound wave.

10. The speaker system according to claim 9, wherein a difference of gain between a transfer characteristic of the synthetic sound wave and the target transfer characteristic is larger than 0 dB and smaller than 12 dB at a predetermined frequency band.

11. The speaker system according to claim 9, wherein the respective transfer characteristics from each of the diaphragms to the sound collector are $P_1$, (i being a number of the diaphragms having different) shapes, the target transfer characteristic is D, respective transfer characteristics of the filters are $H_i$, and the filters are set so as to satisfy a following equation:

$$\Sigma_{i=1}^{N} P_i \cdot H_i = D.$$

12. The speaker system according to claim 1, wherein a difference of gain between respective transfer characteristics of the filters is larger than 0 dB and smaller than 20 dB at a predetermined frequency band.

13. A speaker system, comprising:

a first filter that filters a first signal to generate a second signal;

a second filter that filters the first signal to generate a third signal;

a first speaker having a first diaphragm and a first vibration source installed in the first diaphragm, that converts the second signal into a first sound wave; and a second speaker having a second diaphragm and a second vibration source installed in the second diaphragm, that converts the third signal into a second sound wave, wherein a length of each side of the first diaphragm and a length of each side of the second diaphragm are respectively a multiple of any combination among ($1/\sqrt{2}$, $1/\sqrt{3}$, $1/\sqrt{4}$, $1/\sqrt{5}$, $1/\sqrt{7}$, $1/\sqrt{11}$), each side of the first diaphragm and each side of the second diaphragm have a same ratio of the combination, respective shapes of the first diaphragm and the second diaphragm are different, respective transfer characteristics of the first diaphragm and the second diaphragm are different, and the first filter and the second filter corresponding to the respective transfer characteristics are set such that a transfer characteristic of a synthetic sound wave of the first sound wave and the second sound wave approaches a target transfer characteristic.

14. The speaker system according to claim 13, further comprising:

a package including a front face and a back face opposing the front face, wherein the first diaphragm and the second diaphragm are located on the back face.

15. The speaker system according to claim 13, wherein the first vibration source and the second vibration source are a piezoelectric element respectively.

16. The speaker system according to claim 13, wherein the target transfer characteristic includes a flat transfer characteristic at a frequency band larger than 100 Hz and smaller than 20 kHz in case of musical piece playback, a flat transfer characteristic at a frequency band larger than 100 Hz and smaller than 5 kHz in case of sound reproduction, and a flat transfer characteristic at a frequency band larger than 100 Hz and smaller than 3.5 kHz in case of active noise control.

17. The speaker system according to claim 13, further comprising:

a sound collector that synthesizes the first sound wave and the second sound wave to generate the synthetic sound wave.

18. The speaker system according to claim 17, wherein a difference of gain between a transfer characteristic of the synthetic sound wave and the target transfer characteristic is larger than 0 dB and smaller than 12 dB at a predetermined frequency band.

19. The speaker system according to claim 17, wherein a transfer characteristics from the first diaphragm to the sound collector is $P_1$, a transfer characteristics from the second diaphragm to the sound collector is $P_2$, the target transfer characteristic is D, a transfer characteristic of the first filter is $H_1$, a transfer characteristic of the second filter is $H_2$, and the first filter and the second filter are set so as to satisfy a following equation:

$$P_1 \cdot H_1 + P_2 \cdot H_2 = D.$$

20. The speaker system according to claim 13, wherein a difference of gain between respective transfer characteristics of the first filter and the second filter is larger than 0 dB and smaller than 20 dB at a predetermined frequency band.

21. A speaker system, comprising:

a plurality of filters that filter a first signal to generate a plurality of second signals;

a plurality of speakers that convert the second signals into sound waves, each speaker having a diaphragm and a vibration source installed in the diaphragm, diaphragms of the speakers having at least two different shapes; and a sound collector that synthesizes the sound waves to generate a synthetic sound wave, wherein respective transfer characteristics of the diaphragms are different from each other, each filter corresponding to the respective transfer characteristics is set such that a transfer characteristic of the synthetic sound wave approaches a target transfer characteristic, the respective transfer characteristics from each of the diaphragms to the sound collector are $P_i$, i being a number of the diaphragms having different shapes, the target transfer characteristic is D, respective transfer characteristics of the filters are $H_i$, and the filters are set so as to satisfy a following equation:

$$\Sigma_{i=1}^{N} P_i \cdot H_i = D.$$

22. A speaker system, comprising:

a plurality of filters that filter a first signal to generate a plurality of second signals; and a plurality of speakers that convert the second signals into sound waves, each speaker having a diaphragm and a vibration source installed in the diaphragm, diaphragms of the speakers having at least two different shapes, wherein respective transfer characteristics of the diaphragms are different from each other, each filter corresponding to the respective transfer characteristics is set such that a transfer characteristic of a synthetic sound wave of the sound waves approaches a target transfer characteristic, the respective transfer characteristics from each of the diaphragms to a listener's external auditory canal are $P_i$, i being a number of the diaphragms having different shapes, the target transfer characteristic is D, respective transfer characteristics of the filters are $H_i$, and the filters are set so as to satisfy a following equation:

$$\Sigma_{i=1}^{N} P_i \cdot H_i = D.$$

23. A speaker system, comprising:

a first filter that filters a first signal to generate a second signal;

a second filter that filters the first signal to generate a third signal;

a first speaker having a first diaphragm and a first vibration source installed in the first diaphragm, that converts the second signal into a first sound wave;

a second speaker having a second diaphragm and a second vibration source installed in the second diaphragm, that converts the third signal into a second sound wave; and a sound collector that synthesizes the first sound wave and the second sound wave to generate a synthetic sound wave, wherein respective shapes of the first diaphragm and the second diaphragm are different, respective transfer characteristics of the first diaphragm and the second diaphragm are different, the first filter and the second filter corresponding to the respective transfer characteristics are set such that a transfer characteristic of the synthetic sound wave approaches a target transfer characteristic, a transfer characteristics from the first diaphragm to the sound collector is $P_1$, a transfer characteristics from the second diaphragm to the sound collector is $P_2$, the target transfer characteristic is D, a transfer characteristic of the first filter is $H_1$, a transfer characteristic of the second filter is $H_2$, and the first filter and the second filter are set so as to satisfy a following equation:

$$P_1 \cdot H_1 + P_2 \cdot H_2 = D.$$

24. A speaker system, comprising:

a first filter that filters a first signal to generate a second signal;

a second filter that filters the first signal to generate a third signal;

a first speaker having a first diaphragm and a first vibration source installed in the first diaphragm, that converts the second signal into a first sound wave; and a second speaker having a second diaphragm and a second vibration source installed in the second diaphragm, that converts the third signal into a second sound wave, wherein respective shapes of the first diaphragm and the second diaphragm are different, respective transfer characteristics of the first diaphragm and the second diaphragm are different, the first filter and the second filter corresponding to the respective transfer characteristics are set such that a transfer characteristic of a synthetic sound wave of the first sound wave and the second sound wave approaches a target transfer characteristic, a transfer characteristics from the first diaphragm to a listener's external auditory canal is $P_1$, a transfer characteristics from the second diaphragm to the listener's external auditory canal is $P_2$, the target transfer characteristic is D, a transfer characteristic of the first filter is $H_1$, a transfer characteristic of the second filter is $H_2$, and the first filter and the second filter are set so as to satisfy a following equation:

$$P_1 \cdot H_1 + P_2 \cdot H_2 = D.$$

* * * * *